US012668942B2

(12) United States Patent
Stroyer

(10) Patent No.: US 12,668,942 B2
(45) Date of Patent: Jun. 30, 2026

(54) PILE WITH AN UPHEAVAL RESISTANT SLEEVE

(71) Applicant: Benjamin G Stroyer, Webster, NY (US)

(72) Inventor: Benjamin G Stroyer, Webster, NY (US)

( * ) Notice: Subject to any disclaimer, the term of this patent is extended or adjusted under 35 U.S.C. 154(b) by 61 days.

(21) Appl. No.: 18/765,232

(22) Filed: Jul. 6, 2024

(65) Prior Publication Data

US 2025/0052030 A1 Feb. 13, 2025

Related U.S. Application Data

(60) Provisional application No. 63/527,703, filed on Jul. 19, 2023.

(51) Int. Cl.
*E02D 31/14* (2006.01)
*E02D 5/22* (2006.01)
*E02D 5/56* (2006.01)

(52) U.S. Cl.
CPC ..... *E02D 31/14* (2013.01); *E02D 5/226* (2013.01); *E02D 5/56* (2013.01); *E02D 2300/0007* (2013.01); *E02D 2300/0026* (2013.01)

(58) Field of Classification Search
CPC ..... E02D 31/14; E02D 5/226; E02D 5/56; E02D 2300/0007; E02D 2300/0026; E02D 7/22
See application file for complete search history.

(56) References Cited

U.S. PATENT DOCUMENTS 4,464,083 A * 8/1984 Wathey ..... E02B 17/0021 405/61
4,467,575 A * 8/1984 Dziedzic ..... E02D 5/801 52/157
4,561,231 A * 12/1985 Hoyt ..... E02D 27/42 52/297
4,585,681 A * 4/1986 Kidera ..... E02D 5/60 405/234
4,678,373 A * 7/1987 Langenbach, Jr. ..... E02D 27/48 405/230
4,818,148 A * 4/1989 Takeda ..... E02D 5/60 405/234
5,707,180 A * 1/1998 Vickars ..... E21B 10/44 405/249

(Continued)

FOREIGN PATENT DOCUMENTS

CN 106759273 5/2017
CN 106759273 A * 5/2017 ..... E02D 31/14

(Continued)

OTHER PUBLICATIONS

English Translation CN106759273 (Year: 2017).*
English Translation CN 110700256 (Year: 2021).*
English Translation CN 113235642 (Year: 2021).*
English Translation CN 113565067 (Year: 2022).*

(Continued)

*Primary Examiner* — Jong-Suk (James) Lee
(74) *Attorney, Agent, or Firm* — Michael J. Nickerson

(57) ABSTRACT

A pile for being driven into soil includes a shaft and a frost sleeve (upheaval resistant sleeve) surrounding the shaft. The frost sleeve (upheaval resistant sleeve) is located on the shaft between a top of the soil and a frost line. The pile further includes a grout disruption (separation) plate. The grout disruption (separation) plate is located at the frost line.

16 Claims, 26 Drawing Sheets

(56) References Cited

U.S. PATENT DOCUMENTS

| | | | | |
|---|---|---|---|---|
| 2012/0087740 | A1* | 4/2012 | Stroyer | E02D 11/00 405/241 |
| 2016/0230364 | A1* | 8/2016 | Stroyer | F16D 1/02 |
| 2020/0165788 | A1 | 5/2020 | Stroyer | |
| 2022/0042267 | A1* | 2/2022 | Stroyer | E02D 5/24 |

FOREIGN PATENT DOCUMENTS

| | | | | | |
|---|---|---|---|---|---|
| CN | 110700256 | B | * | 3/2021 | E04H 12/2223 |
| CN | 113235642 | A | * | 8/2021 | E02D 5/60 |
| CN | 115059122 | | | 9/2022 | |
| CN | 115075282 | A | * | 9/2022 | E02D 5/60 |
| CN | 113565067 | B | * | 11/2022 | H02J 7/35 |
| CN | 113944194 | B | * | 3/2023 | E02D 27/12 |
| CN | 218667498 | U | * | 3/2023 | |
| CN | 116122273 | A | * | 5/2023 | E02D 5/56 |
| CN | 118895782 | A | * | 11/2024 | G06F 30/20 |
| GB | 2557981 | | | 7/2018 | |
| WO | WO2016095021 | | | 6/2016 | |
| WO | WO-2016095021 | A1 | * | 6/2016 | E02D 5/28 |

OTHER PUBLICATIONS

English Translation CN 113944194 (Year: 2023).*
English Translation CN115075282 (Year: 2022).*
English Translation CN 116122273 (Year: 2017).*
English Translation CN 118895782 (Year: 2024).*
English Translation CN 218667498 (Year: 2023).*
'The Techno Metal products: Post's exclusive sleeve.' (MRH Engineering PC), (Dec. 10, 2022), [online], (retrieved from the internet on Nov. 11, 2024) URL https://web.archive.orgiweb/ 20221210100517/ https://mrhengineeringpc.com/techno-metal-post-engineering/techno-metal- post-products/>, entire document, especially top figure on p. 1.
'Solar Pile Sleeves' (Yellow Jacket), (Jun. 27, 2023) [online], (retrieved from the internet on Nov. 11, 2024) URL https://web.archive.org/web/20230627012159/https://www.foundationtechnologies.com/files/documents/Y.Lsolar_campaign_flyer.pdf>, entire document.
International Search Report PCT/US2024/036974 (Feb. 4, 25).
International Preliminary Report on Patentability PCT/US2024/036974 (Jan. 29, 2026).

* cited by examiner

PILE WITH AN UPHEAVAL RESISTANT SLEEVE

PRIORITY INFORMATION

The present application claims priority, under 35 U.S.C. § 119(e), from U.S. Provisional Patent Application Ser. No. 63/527,703, filed on Jul. 19, 2023. The entire content of U.S. Provisional Patent Application Ser. No. 63/527,703, filed on Jul. 19, 2023, is hereby incorporated by reference.

BACKGROUND

Conventional piles are metal tubes having either a circular or a rectangular cross-section. Such piles are mounted in the ground to provide a support structure for the construction of superstructures. The piles are provided in sections that are driven into the ground.

An example of a conventional pile is illustrated in FIG. 1. More specifically, FIG. 1 is a schematic view of one embodiment of an auger grouted pile.

As illustrated in FIG. 1, an auger grouted pile 100 includes an elongated, tubular pipe 102 with a hollow central chamber, a top section 104 and a bottom section 106. Bottom section 106 includes a soil (medium) displacement head 108. Top section 104 includes a reverse auger 110. Soil (medium) displacement head 108 has a helical blade 112 that has a leading edge 114 and a trailing edge 116.

The leading edge 114 of helical blade 112 cuts into the soil (medium) as the pile is rotated into the soil (medium) at such contact point. The soil (medium) displacement head 108 may be equipped with a point 118 to promote this cutting.

The soil (medium) passes over helical blade 112 and thereafter past trailing edge 116. The uppermost portion of helical blade 112 includes a deformation structure 120 that displaces the soil (medium) to create irregularities in an annulus formed by a lateral compaction element 119.

It is noted that some conventional piles have a cutting tip that permits them to be rapidly deployed. By rotating the pile, the helical blade pulls the pile into the ground (medium), thus greatly reducing the amount of downward force necessary to bury the pile. Unfortunately, the rotary action of the pile also loosens the soil which holds the pile in place. This reduces the amount of vertical support the pile provides.

Sometimes, grout or other supporting medium is introduced around the pile in an attempt to solidify the volume around the pile and thus compensate for the loose soil. In addition, to providing grout to the area around the pile, the grout, to be effective, needs to be able to grip or have a frictional contact with the pile to prevent any slippage between the grout and the pile, thereby strengthening the vertical support the pile provides.

U.S. Pat. No. 6,817,810 discloses a helical pile that includes a shaft with rounded notches laid out in a precise non-random pattern to facilitate a helical plate to be screwed onto the shaft.

The rounded notches are only on the extreme corners of the square shaft and thereby the rounded notches do not provide a substantial resistance to shear in the supporting medium or grout that may be added to the bore hole. Moreover, the rounded nature of the notches on the shaft does not provide gripping or frictional contact with the grout to prevent slippage between the grout and the pile.

Additionally, the very small area of the notches on the shaft does not provide gripping or frictional contact with the supporting medium or grout to prevent any slippage between the supporting medium or grout and the pile.

In various situations, piles are not driven down very far into the soil (medium) because the piles are not required to support a large vertical weight or force. These piles, depending on the environment, may be driven to a depth wherein the pile can be forced or pull upwardly by the surrounding soil (medium) during times of frost or freezing temperature (frost upheaval).

Moreover, during times of frost, the upward pulling force of the surrounding soil (medium) can cause the grout surrounding the pile to rise, thereby impacting the lateral strength that the grout is supposed to provide to the pile.

Conventional piles fail to compensate for the potential upheaval, thereby causing the conventional piles to be pulled or forced upwardly out of the surrounding soil (medium).

Additionally, conventional piles fail to compensate for the potential upheaval, thereby causing the surrounding grout to be pulled or forced upwardly, thereby impacting the lateral strength that the grout is supposed to provide to the pile.

Therefore, it is desirable to provide a pile that is configured to reduce or eliminate the pulling or forcing upwardly of the pile out of the surrounding soil (medium).

Additionally, it is desirable to provide a pile that is configured to reduce or eliminate the pulling or forcing upwardly of the surrounding grout.

Also, it is desirable to provide a pile that is configured to resist the pulling or forcing upwardly of the pile out of the surrounding soil (medium).

Furthermore, it is desirable to provide a pile that is configured to resist the pulling or forcing upwardly of the surrounding grout.

Additionally, it is desirable to provide a sleeve for a shaft of a pile that is configured to reduce or eliminate the pulling or forcing upwardly of the pile out of the surrounding soil (medium).

Moreover, it is desirable to provide a plate that is configured to reduce or eliminate the pulling or forcing upwardly of the surrounding grout.

It is also desirable to provide a plate that is configured to resist the pulling or forcing upwardly of the surrounding grout.

It is desirable to provide a sleeve for a shaft of a pile that is configured to resist the pulling or forcing upwardly of the pile out of the surrounding soil (medium).

It is further desirable to provide a sleeve for a shaft of a pile that is configured to resist the pulling or forcing upwardly of the pile out of the surrounding soil (medium) and configured to resist the pulling or forcing upwardly of the surrounding grout Lastly, it is desirable to provide a sleeve for a shaft of a pile that is configured to reduce or eliminate the pulling or forcing upwardly of the pile out of the surrounding soil (medium) and configured to reduce or eliminate the pulling or forcing upwardly of the surrounding grout.

BRIEF DESCRIPTION OF THE DRAWINGS

The drawings are only for purposes of illustrating various embodiments and are not to be construed as limiting, wherein.

DETAILED DESCRIPTION

Figure 1:
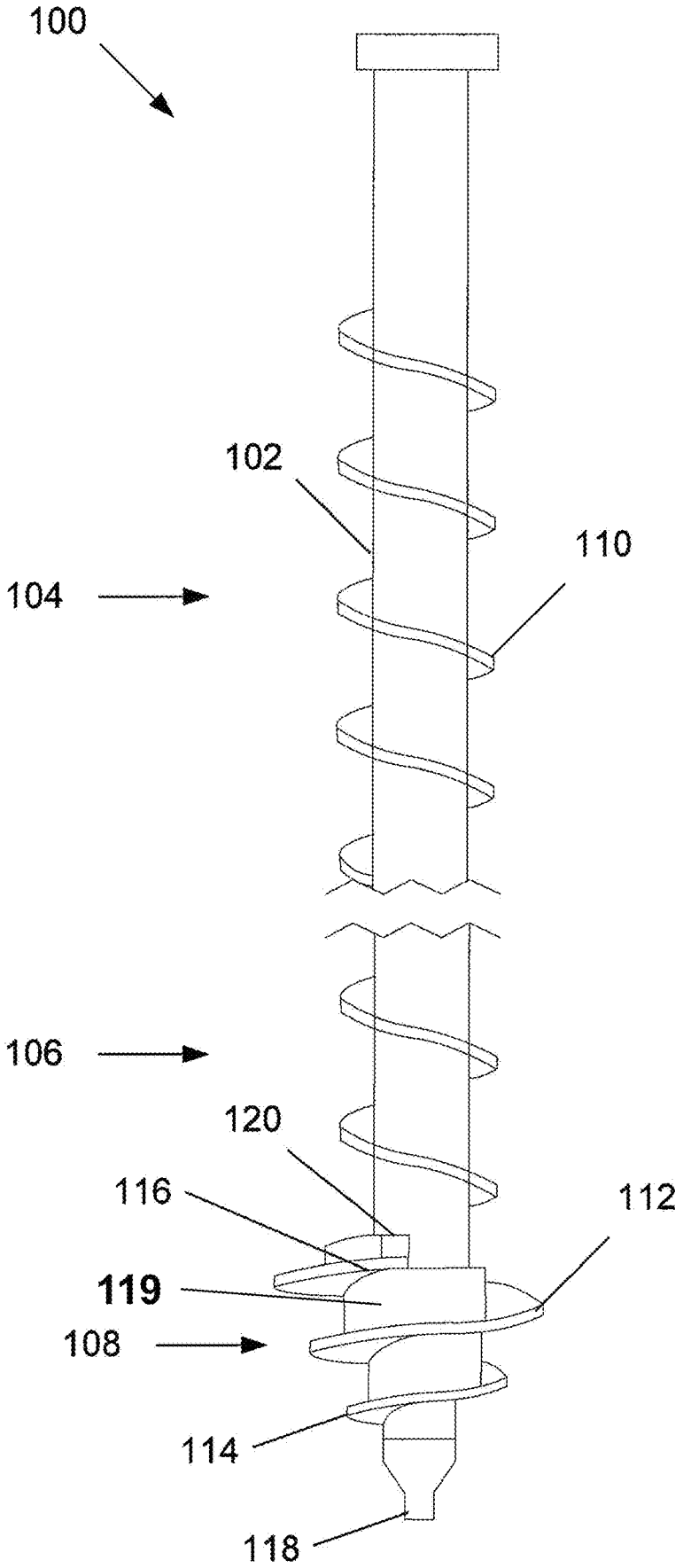
FIG. 1 illustrates a conventional pile.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 2:
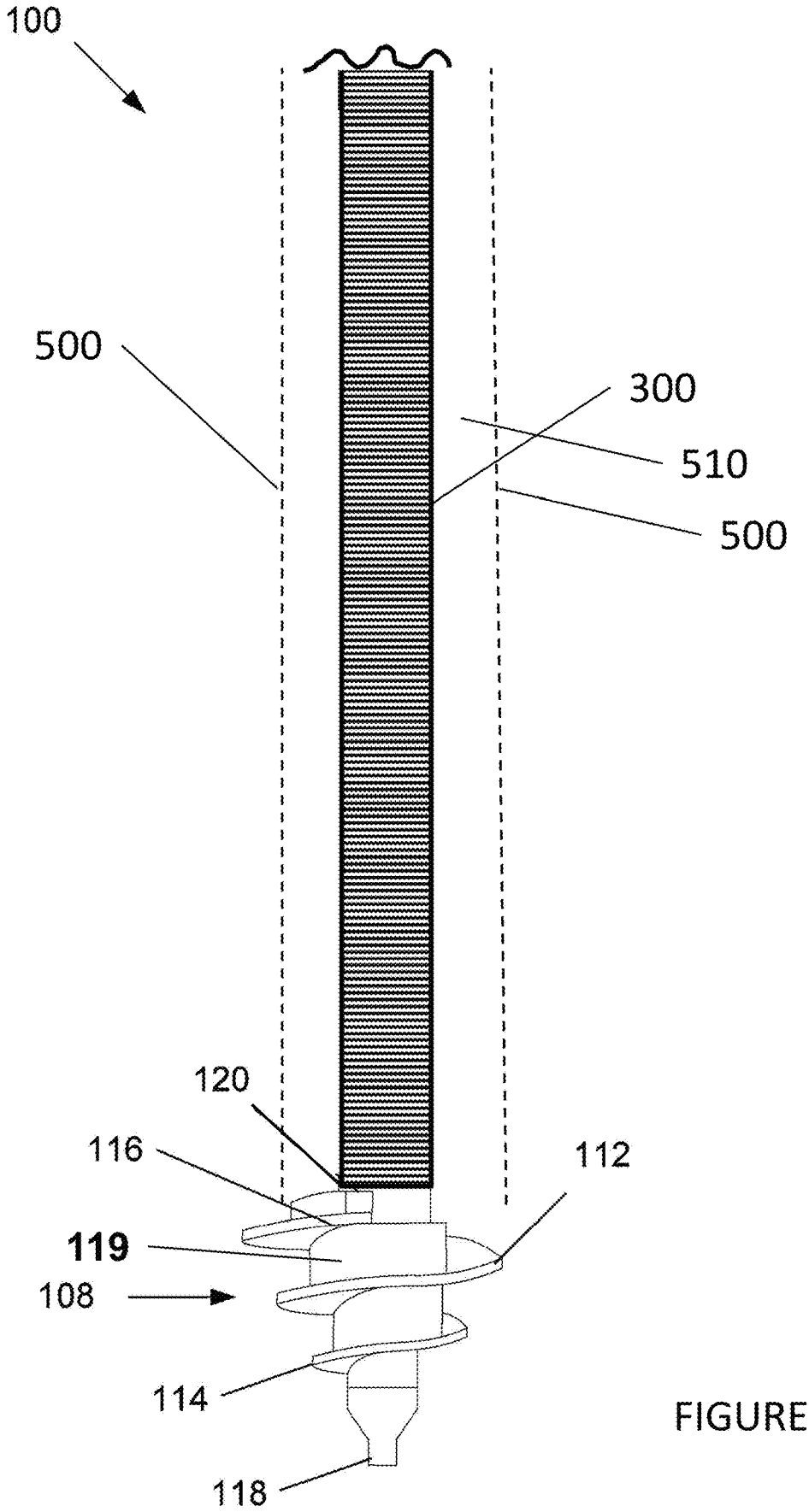
FIG. 2 illustrates an example of a pile for providing gripping contact with a supporting medium or grout and resisting the supporting medium or grout from shearing.

An example of a pile for providing gripping contact with a supporting medium or grout and resisting the supporting medium or grout from shearing is illustrated in FIG. 2. More specifically, FIG. 2 is a schematic view of one embodiment of a pile.

As illustrated in FIG. 2, a pile 100 includes a threaded shaft 300. A bottom section of the pile 100 includes a soil (medium) displacement head 108. Soil (medium) displacement head 108 has a helical blade 112 that has a leading edge 114 and a trailing edge 116.

It is noted that the threaded shaft 300 may be realized by including a single continuous raised helical thread (rib) on the outer surface of the shaft or a single continuous helical channel on the outer surface of the shaft. It is further noted that the threaded shaft 300 may be realized by including a plurality of non-helical parallel deformations, each non-helical parallel deformations encircling the entire outer surface of the shaft. It is additionally noted that the threaded shaft 300 may be realized by including a plurality of non-helical parallel raised rings, each raised ring encircling the entire outer surface of the shaft. It is also noted that the threaded shaft 300 may be realized by including a plurality of non-helical parallel ringed channels, each ringed channel encircling the entire outer surface of the shaft.

A non-helical parallel deformation, a non-helical parallel raised ring, and/or a non-helical parallel ringed channel, as used in describing the threaded shaft 300, form a plane, wherein the plane, formed by the non-helical parallel deformation, non-helical parallel raised ring, and/or non-helical parallel ringed channel, is orthogonal, in two dimensions, to a central axis of the threaded shaft 300. On the other hand, a helical deformation (continuous raised helical thread or continuous helical channel), as used in describing the threaded shaft 300, forms a plane, wherein the plane, formed by the helical deformation (continuous raised helical thread or continuous helical channel), is not orthogonal, in two dimension, to a central axis of the threaded shaft 300.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (lateral compaction elements 200 are discussed in more detail below with respect to FIGS. 6, 8, 10, and 12). The lateral compaction elements 119 create an annulus having outer wall 500 and void 510.

The uppermost portion of helical blade 112 may include a deformation structure 120 (located near the trailing edge 116) that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the threaded shaft 300 of the pile 100. The threaded surface of the threaded shaft 300 of the pile 100 provides a gripping interface between the supporting medium or grout and the pile 100, as well as, provides an interface that resists the supporting medium or grout from shearing along the surface between the supporting medium or grout and the pile 100.

Figure 3:
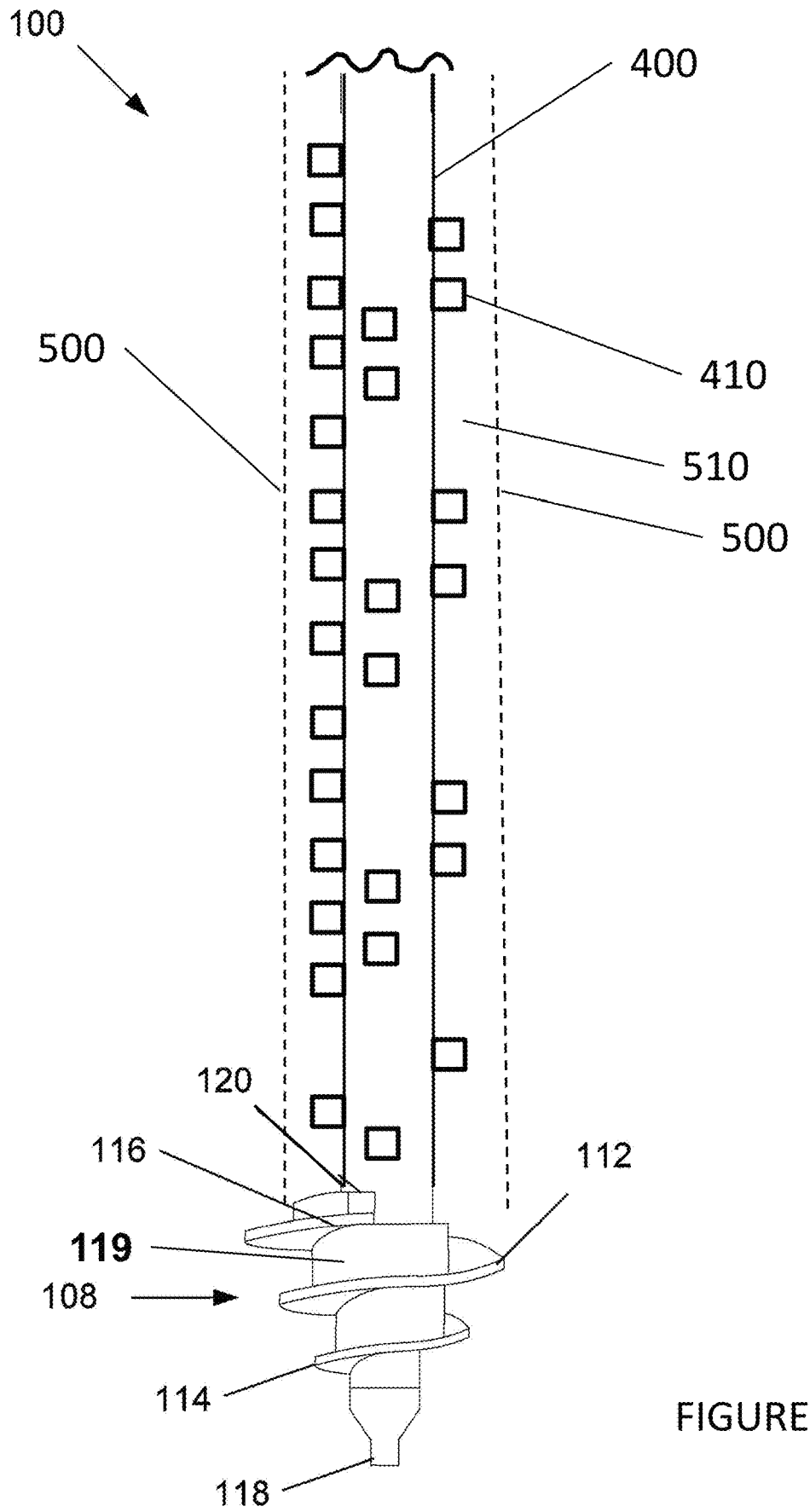
FIG. 3 illustrates another example of a pile for providing gripping contact with a supporting medium or grout and resisting the supporting medium or grout from shearing.

Another example of a pile for providing gripping contact with the supporting medium or grout and resisting the supporting medium or grout from shearing is illustrated in FIG. 3. More specifically, FIG. 3 is a schematic view of one embodiment of a pile.

As illustrated in FIG. 3, a pile 100 includes a shaft 400 having projections 410 on the outer surface. The projections (protrusions) 410 may be randomly placed on the outer surface of the shaft 400 or be placed in a pattern. The projections (protrusions) 410 extend out from the outer surface of the shaft 400 into the void 510 of an annulus without coming into contact with an outer wall 500 of the annulus.

Preferably, the projections (protrusions) 410 increase the area of the skin resistance with the supporting medium or grout to resist the grout from shearing along the surface between the supporting medium or grout and the shaft 400.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (discussed in more detail below). The lateral compaction elements 119 create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the projections (protrusions) 410 of the shaft 400. The projections (protrusions) 410 of the shaft 400 provide gripping interface between the supporting medium or grout and the shaft 400, as well as, provide an interface that resists the supporting medium or grout from shearing along the surface between the supporting medium or grout and the shaft 400.

Figure 4:
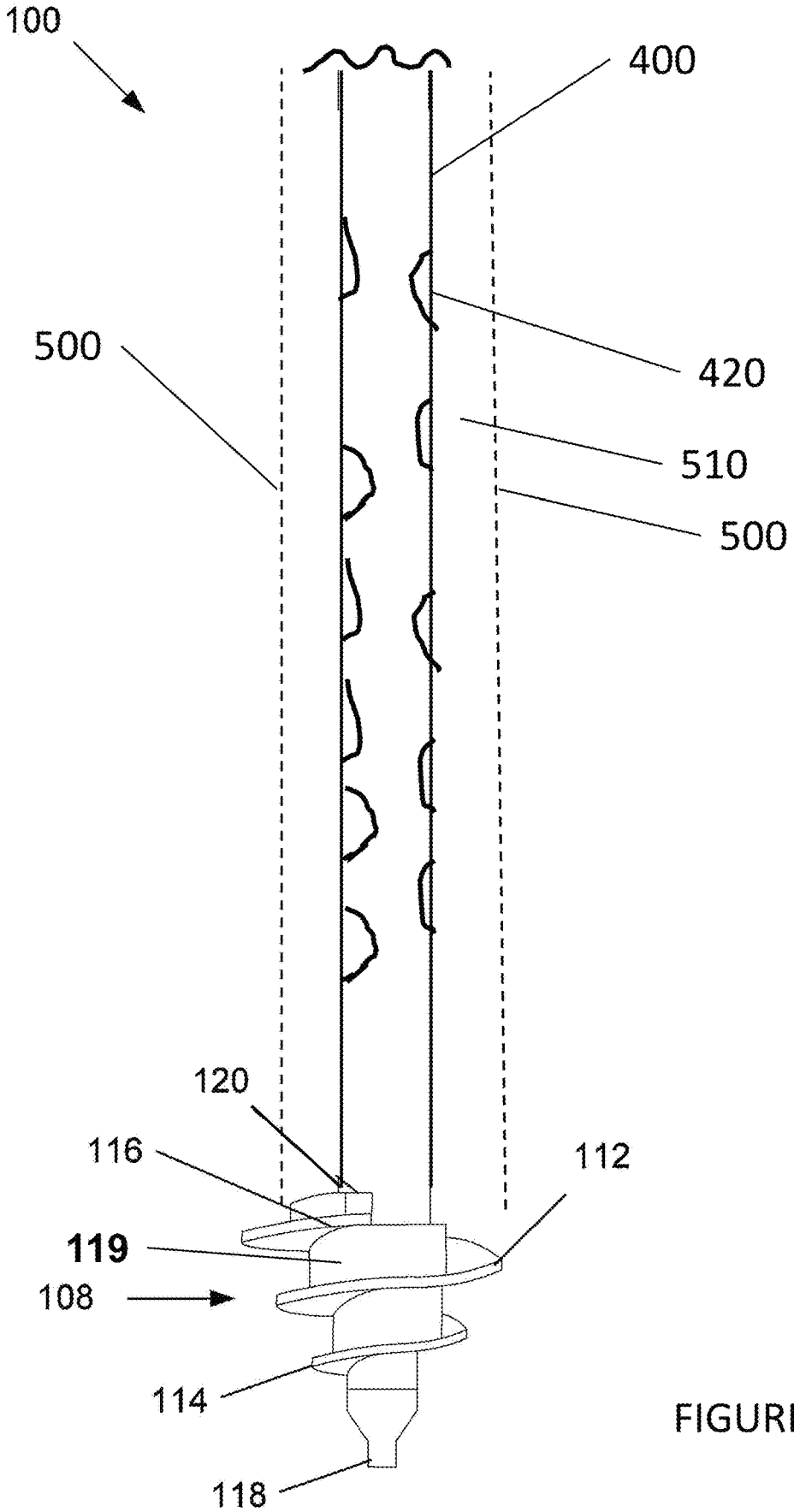
FIG. 4 illustrates a third example of a pile for providing gripping contact with a supporting medium or grout and resisting the supporting medium or grout from shearing.

A third example of a pile for providing gripping contact with the supporting medium or grout and resisting the supporting medium or grout from shearing is illustrated in FIG. 4. More specifically, FIG. 4 is a schematic view of one embodiment of a pile.

As illustrated in FIG. 4, a pile 100 includes a shaft 400 having indentations 420 on the outer surface. The indentations 420 may be randomly placed on the outer surface of the shaft 400 or be placed in a pattern. The indentations 420 extend inwardly from the outer surface of the shaft 400 away from the void 510 of an annulus. The indentations 420 do not extend into the center of the shaft 400; thus, the indentations 420 do not create a hole or opening between a hollow interior of the shaft 400 and an exterior surface of the shaft 400. More specifically, the indentations 420 have a solid bottom surface and solid side surfaces such that the indentations 420 are formed in the surface of the shaft 400, not through the shaft 400.

Preferably, the indentations 420 increase the area of the skin resistance with the supporting medium or grout to resist the supporting medium or grout from shearing along the surface between the supporting medium or grout and the shaft 400.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (discussed in more detail below). The lateral compaction elements 119 create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the indentations 420 of the shaft 400. The indentations 420 of the shaft 400 provide gripping interface between the supporting medium or grout and the shaft 400, as well as, provide an interface that resists the supporting medium or grout from shearing along the surface between the supporting medium or grout and the shaft 400.

Figure 5:
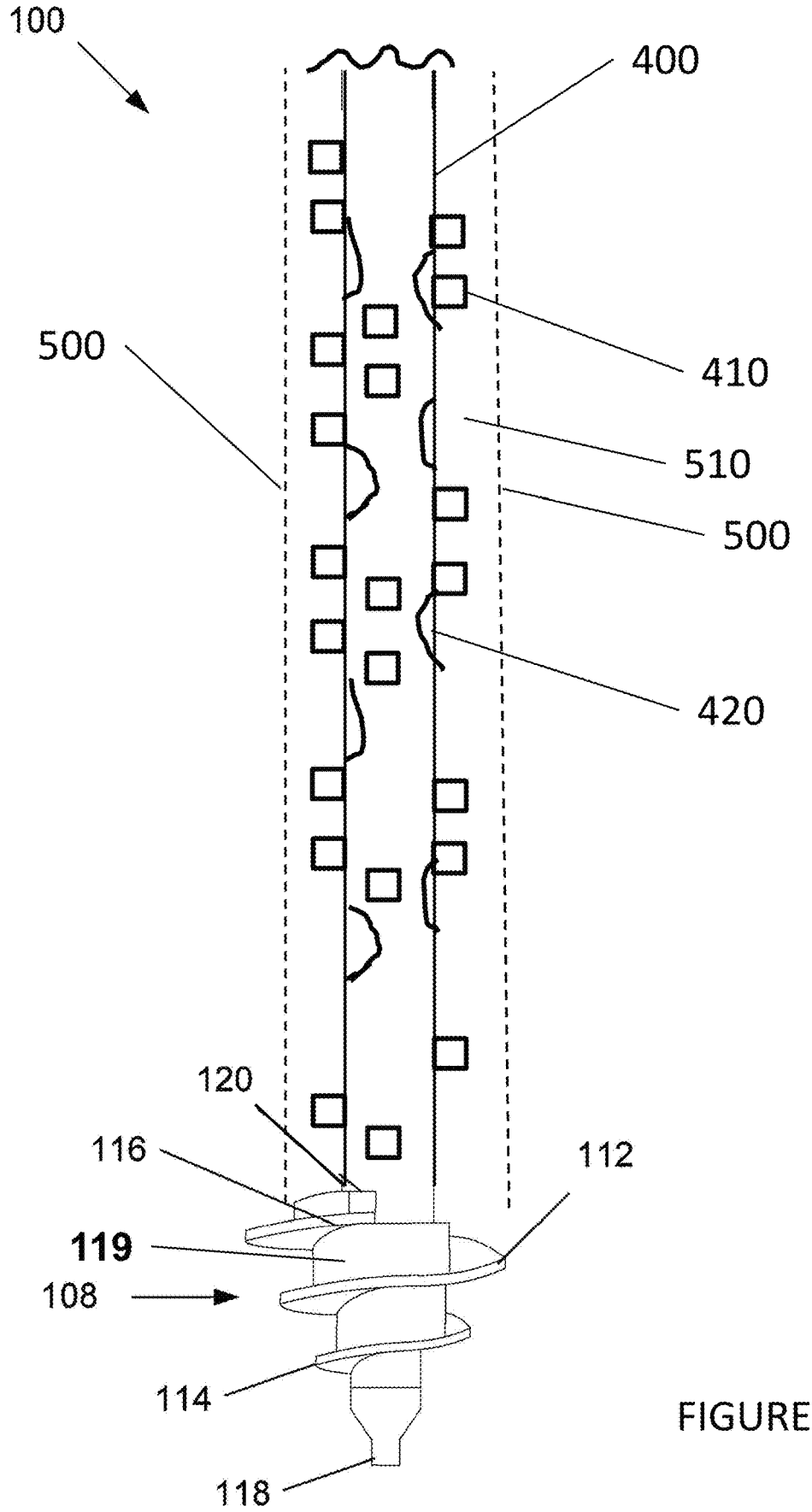
FIG. 5 illustrates a fourth example of a pile for providing gripping contact with a supporting medium or grout and resisting the supporting medium or grout from shearing.

A fourth example of a pile for providing gripping contact with the supporting medium or grout and resisting the supporting medium or grout from shearing is illustrated in FIG. 5. More specifically, FIG. 5 is a schematic view of one embodiment of a pile.

As illustrated in FIG. 5, a pile 100 includes a shaft 400 having indentations 420 and projections (protrusions) 410 on the outer surface. The indentations 420 and projections (protrusions) 410 may be randomly placed on the outer surface of the shaft 400 or be placed in a pattern. The indentations 420 extend inwardly from the outer surface of the shaft 400 away from the void 510 of an annulus, and the projections (protrusions) 410 extend out from the outer surface of the shaft 400 into the void 510 of an annulus without coming into contact with an outer wall 500 of the annulus.

Preferably, the projections (protrusions) 410 and the indentations 420 increase the area of the skin resistance with the supporting medium or grout to resist the supporting medium or grout from shearing along the surface between the supporting medium or grout and the shaft 400.

A bottom section of the pile 100 includes a soil (medium) displacement head 108. Soil (medium) displacement head 108 has a helical blade 112 that has a leading edge 114 and a trailing edge 116.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements (discussed in more detail below). The lateral compaction elements create an annulus having outer wall 500 and void 510.

The uppermost portion of helical blade 112 may include a deformation structure 120 that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the indentations 420 and projections (protrusions) 410 of the shaft 400. The indentations 420 and projections (protrusions) 410 of the shaft 400 provide gripping interface between the supporting medium or grout and the shaft 400, as well as, provide an interface that resists the supporting medium or grout from shearing along the surface between the supporting medium or grout and the shaft 400.

Figure 6:
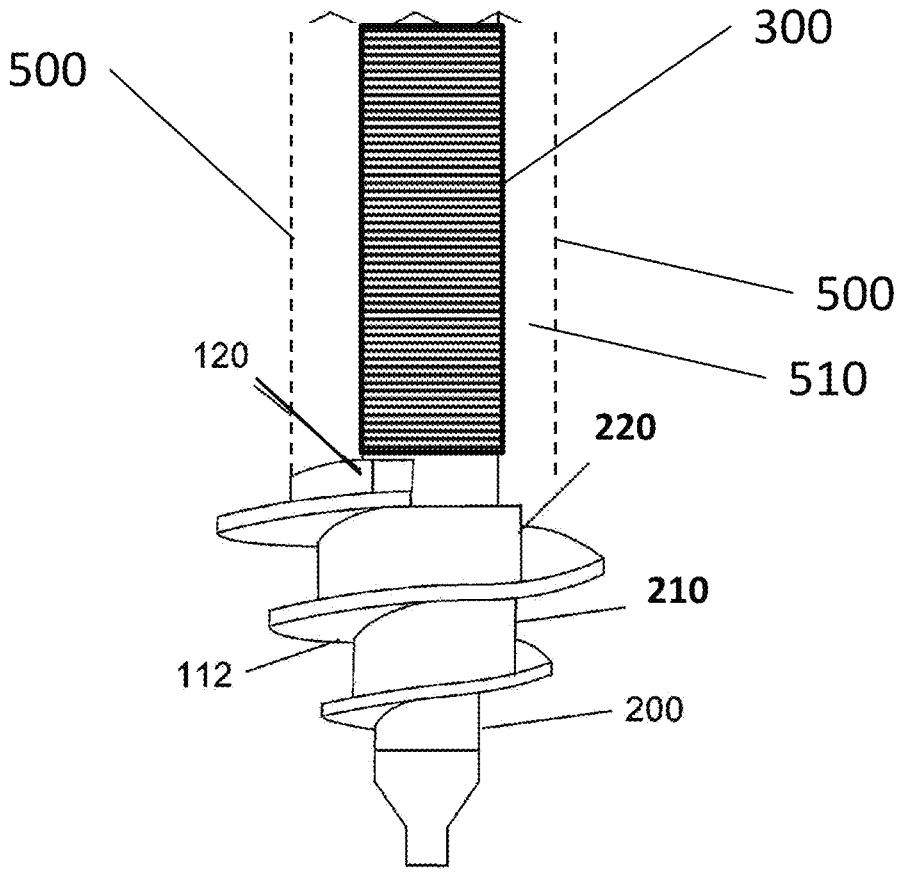
FIGS. 6 and 7 illustrate a bottom section of the pile of FIG. 2.
Figure 7:
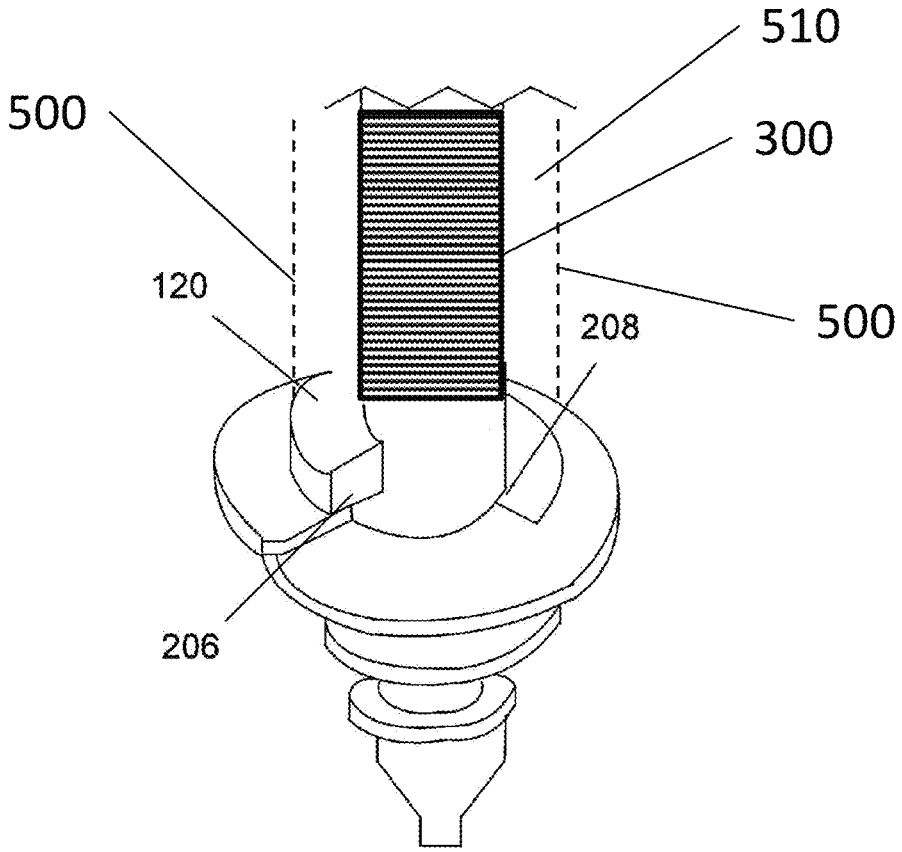

FIGS. 6 and 7 are side and perspective views of the bottom section of the pile of FIG. 2. The bottom section includes at least one lateral compaction element. In the embodiment shown in FIGS. 6 and 7, there are three such lateral compaction elements. The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 220 has established an annulus with a regular diameter, deformation structure 120 cuts into the edge of the outer wall 500 of the annulus to leave a spiral pattern in the annulus's perimeter or circumference.

It is noted that, as illustrated in FIG. 7, the deformation structure 120 has a height that changes over the length of the deformation structure 120 from its greatest height at end 206 to a lesser height at end 208 as the deformation structure 120 coils about the pile in a helical configuration.

Figure 8:
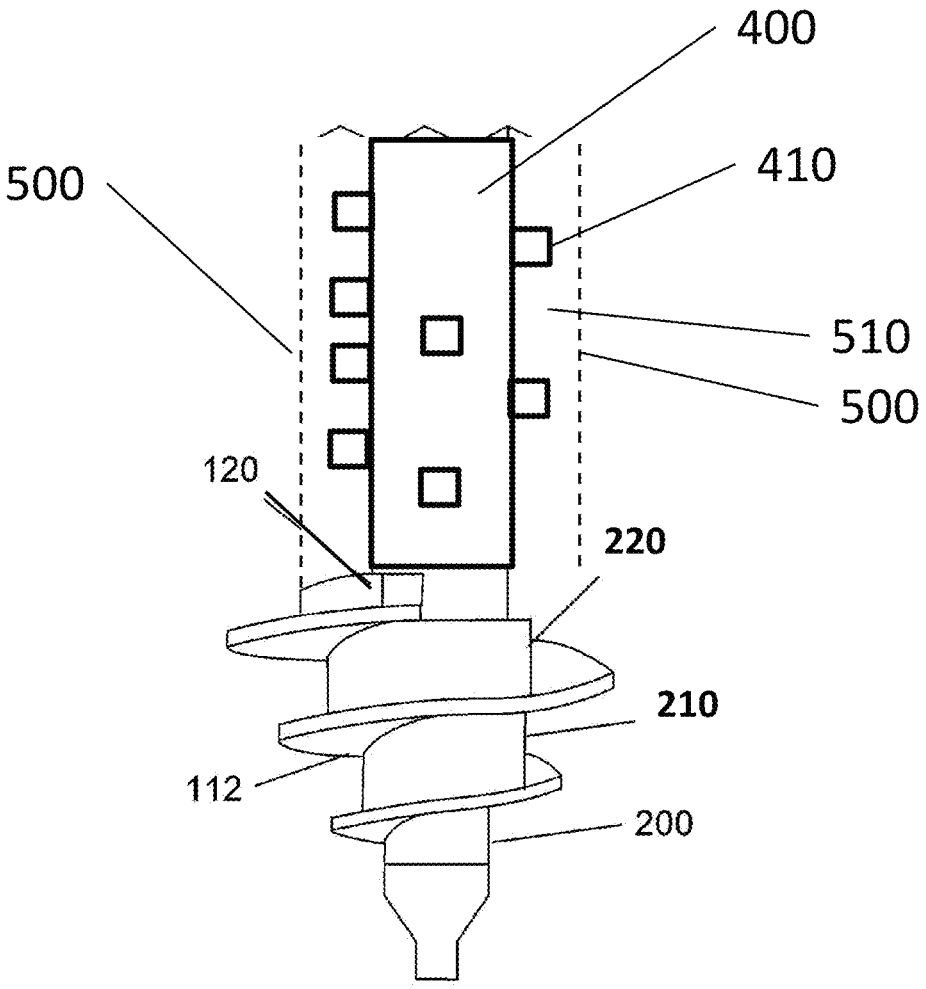
FIGS. 8 and 9 illustrate a bottom section of the pile of FIG. 3.
Figure 9:
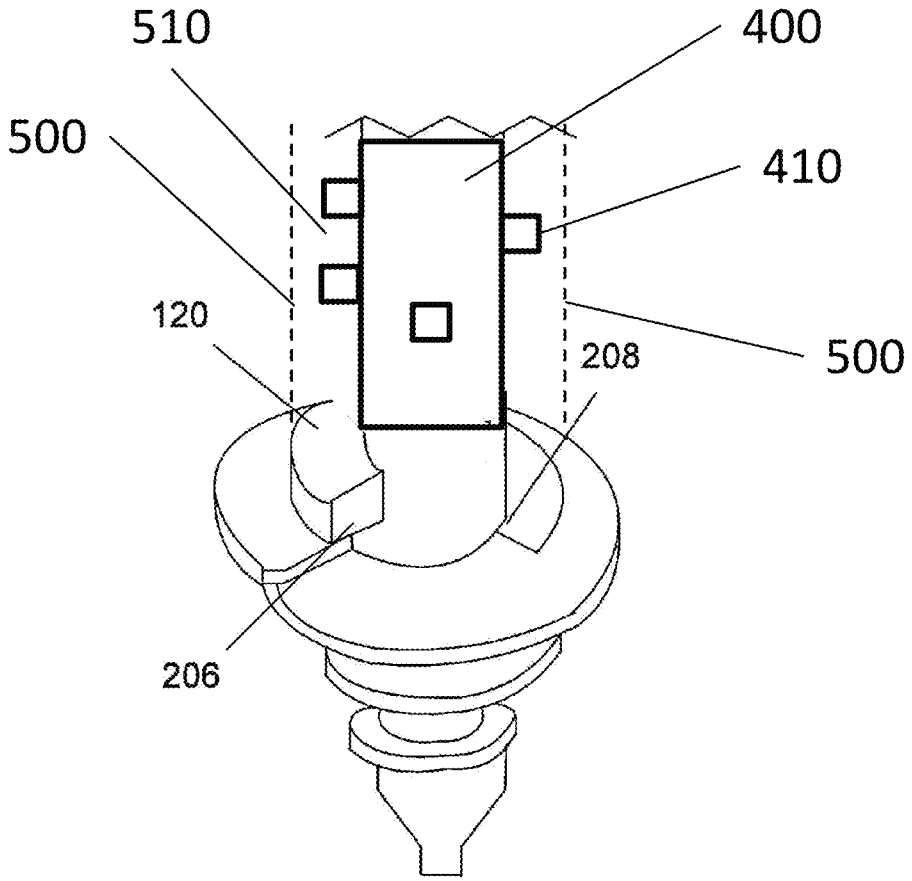

FIGS. 8 and 9 are side and perspective views of the bottom section of the pile of FIG. 3. The bottom section includes at least one lateral compaction element. In the embodiment shown in FIGS. 8 and 9, there are three such lateral compaction elements. The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 9, the deformation structure 120 has a height that changes over the length of the deformation structure 120 from its greatest height at end 206 to a lesser height at end 208 as the deformation structure 120 coils about the pile in a helical configuration.

Figure 10:
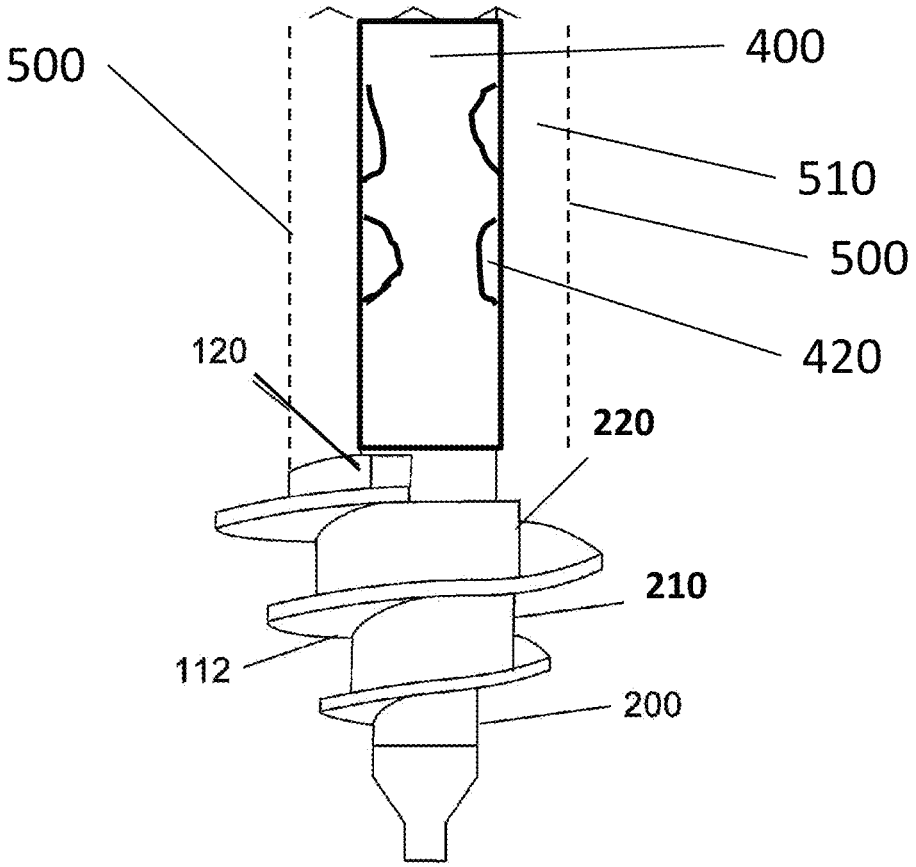
FIGS. 10 and 11 illustrate a bottom section of the pile of FIG. 4.
Figure 11:
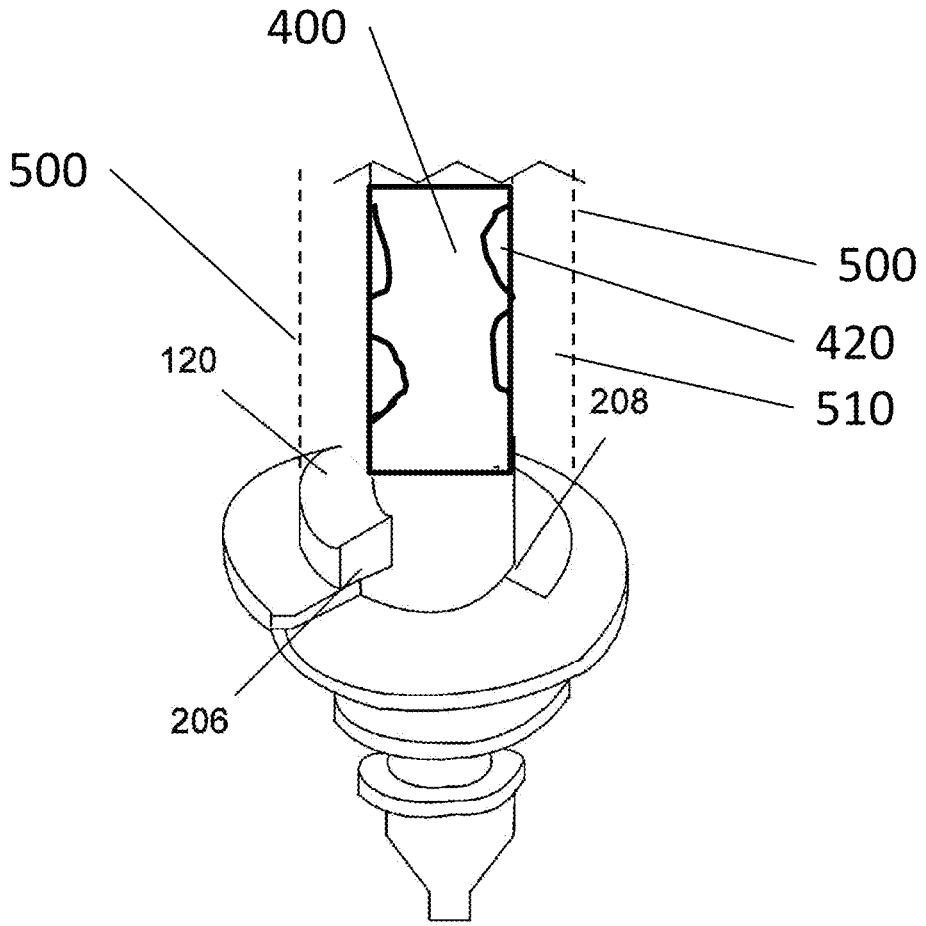

FIGS. 10 and 11 are side and perspective views of the bottom section of the pile of FIG. 4. The bottom section includes at least one lateral compaction element. In the embodiment shown in FIGS. 10 and 11, there are three such lateral compaction elements.

The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 11, the deformation structure 120 has a height that changes over the length of the deformation structure 120 from its greatest height at end 206 to a lesser height at end 208 as the deformation structure 120 coils about the pile in a helical configuration.

Figure 12:
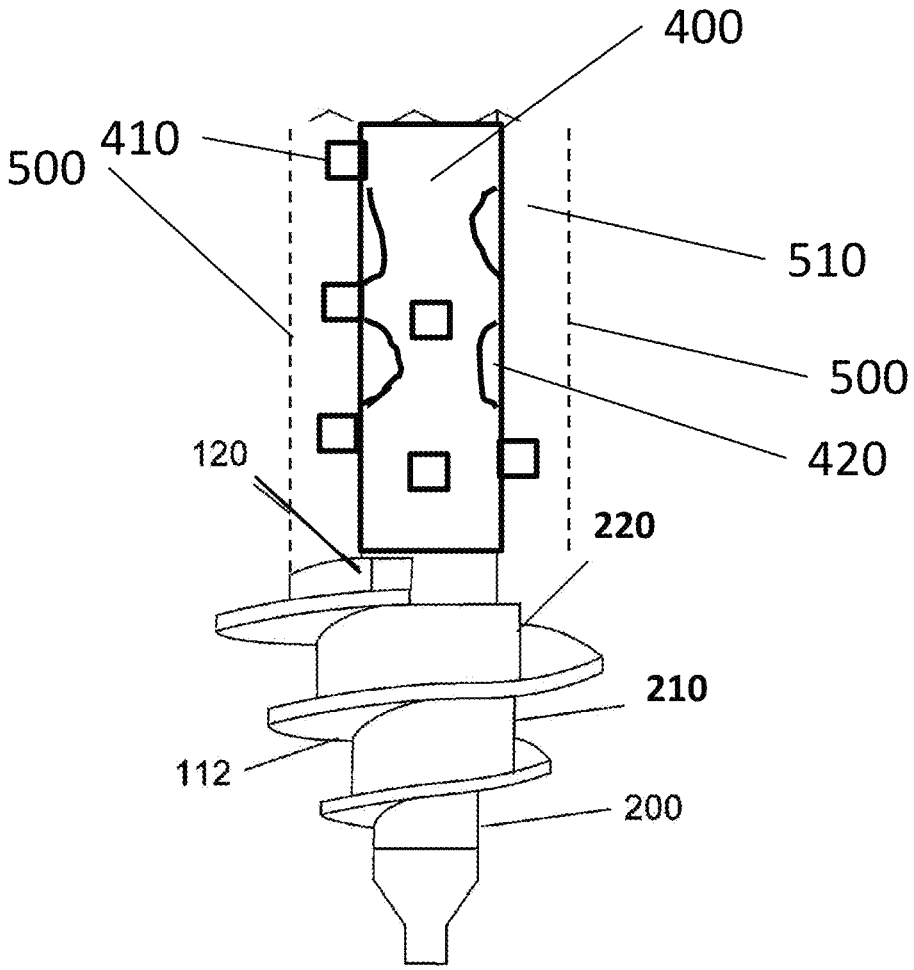
FIGS. 12 and 13 illustrate a bottom section of the pile of FIG. 5.
Figure 13:
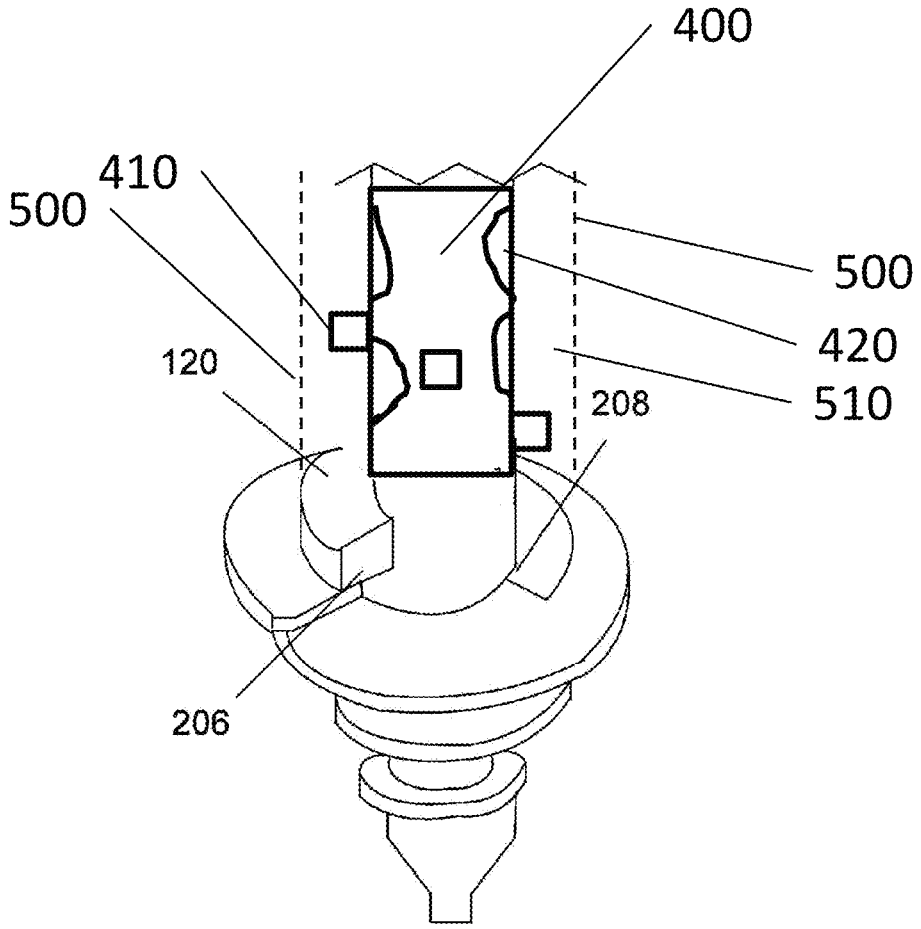

FIGS. 12 and 13 are side and perspective views of the bottom section of the pile of FIG. 5. The bottom section includes at least one lateral compaction element. In the embodiment shown in FIGS. 12 and 13, there are three such lateral compaction elements.

The lateral compaction element 200 near the end of the pile has a diameter less than the diameter from the lateral compaction element 220 near deformation structure 120. The lateral compaction element 210 in the middle has a diameter that is between the diameters of the other two lateral compaction elements.

In this fashion, the soil is laterally compacted by the first lateral compaction element 200, more compacted by the second lateral compaction element 210 (enlarging the diameter of the bored hole) and even more compacted by the third lateral compaction element 220.

The helical blade 112 primarily cuts into the soil and only performs minimal soil compaction. The deformation structure 120 is disposed above the lateral compaction elements (200, 210, and 220). After the widest compaction element 200 has established an annulus with a regular diameter, deformation structure 120 cuts into the edge of the outer wall 500 of the annulus to leave a spiral pattern in the annulus's perimeter or circumference.

It is noted that, as illustrated in FIG. 13, the deformation structure 120 has a height that changes over the length of the deformation structure 120 from its greatest height at end 206 to a lesser height at end 208 as the deformation structure 120 coils about the pile in a helical configuration.

Figure 14:
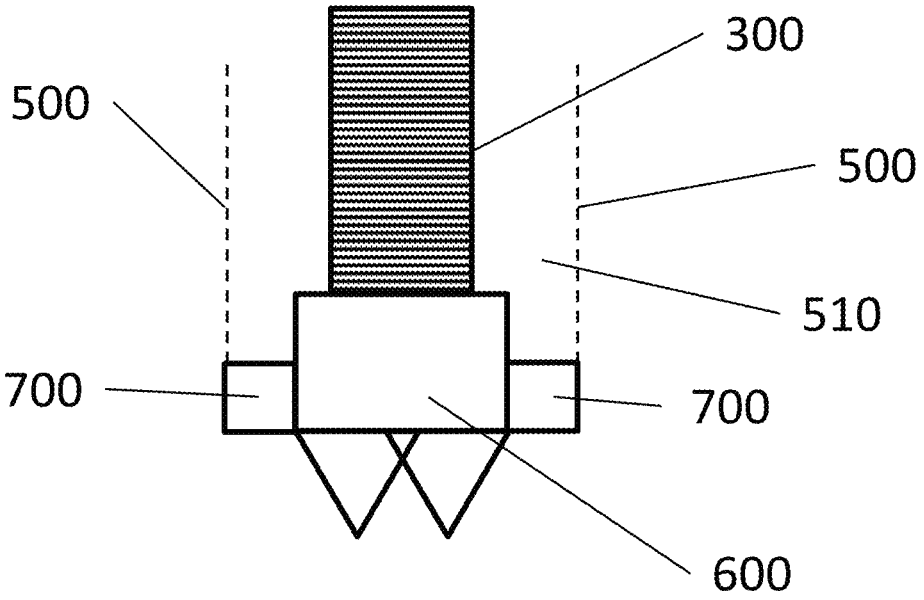
FIG. 14 illustrates another example of bottom section of the pile of FIG. 2.

FIG. 14 illustrates another example of a bottom section of the pile of FIG. 2. As illustrated in FIG. 14, the pile includes a threaded shaft 300.

It is noted that the threaded shaft 300 may be realized by including a single continuous raised helical thread (rib) on the outer surface of the shaft or a single continuous helical channel on the outer surface of the shaft. It is further noted that the threaded shaft 300 may be realized by including a plurality of raised rings, each raised ring encircling the outer surface of the shaft. It is also noted that the threaded shaft 300 may be realized by including a plurality of ringed channels, each ringed channel encircling the outer surface of the shaft.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 15:
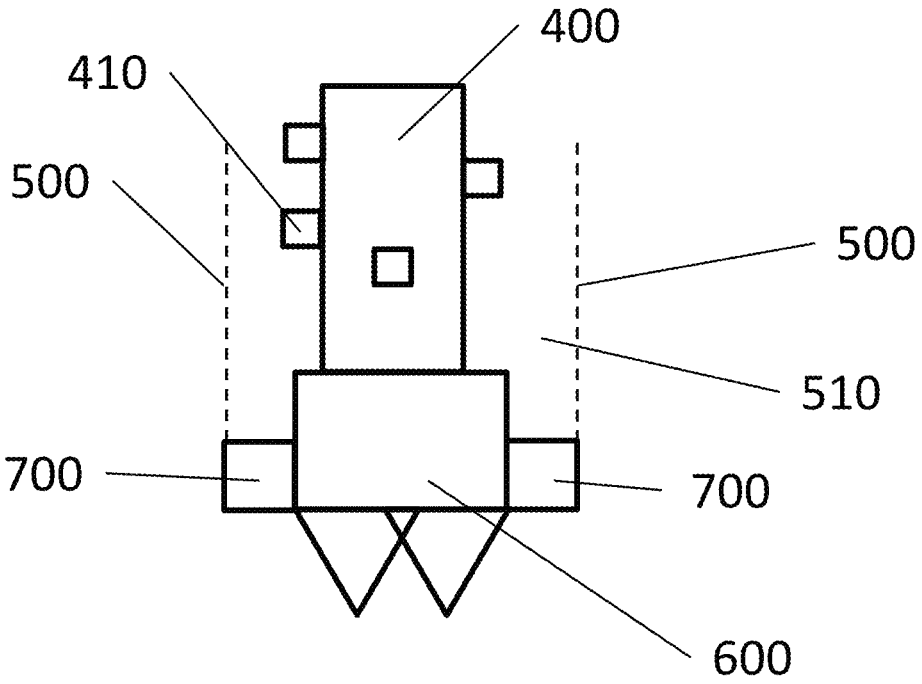
FIG. 15 illustrates another example of bottom section of the pile of FIG. 3.

FIG. 15 illustrates another example of a bottom section of the pile of FIG. 3. As illustrated in FIG. 15, the pile includes a plurality of projections (protrusions) 410 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 16:
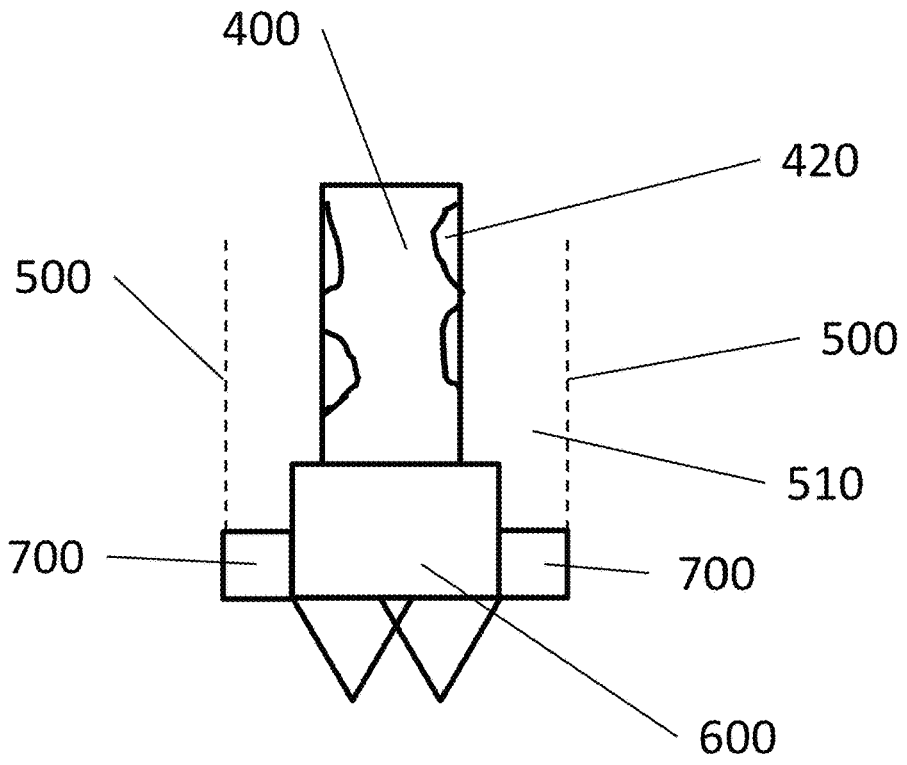
FIG. 16 illustrates another example of bottom section of the pile of FIG. 4.

FIG. 16 illustrates another example of a bottom section of the pile of FIG. 4. As illustrated in FIG. 16, the pile includes a plurality of indentations 420 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 17:
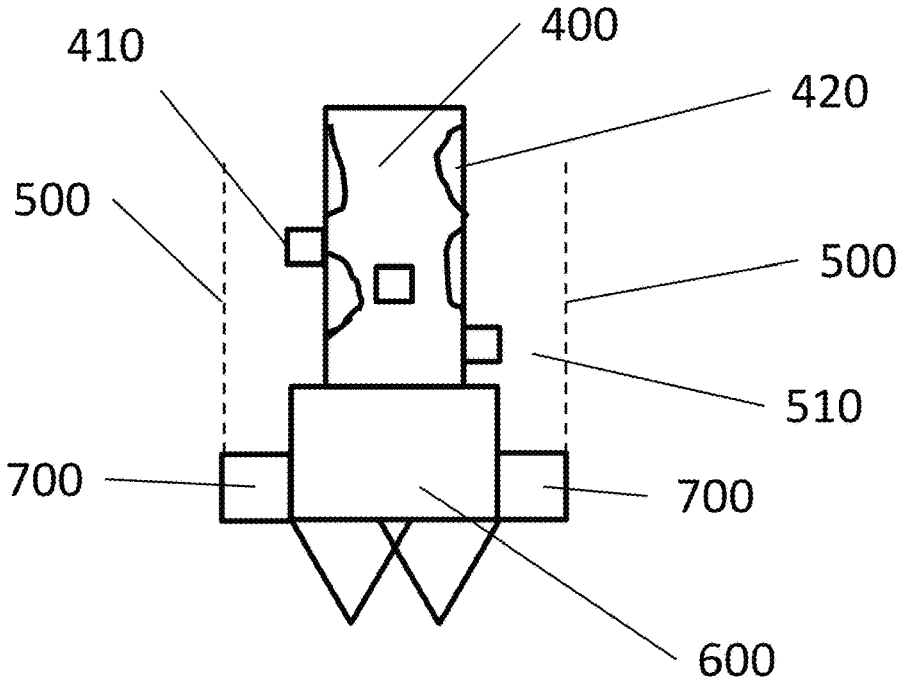
FIG. 17 illustrates another example of bottom section of the pile of FIG. 5.

FIG. 17 illustrates another example of a bottom section of the pile of FIG. 5. As illustrated in FIG. 17, the pile includes a plurality of projections (protrusions) 410 and a plurality of indentations 420 on the outer surface of a shaft 400.

The bottom section of the pile also includes a soil (medium) loosen bit or head 600 to loosen the soil (medium) around the pile as the pile is driven therein. The soil (medium) loosen bit or head 600 includes a lateral compaction structure 700 to laterally compact the loosen soil (medium) to create an annulus with an outer wall 500 and a void 510.

Figure 18:
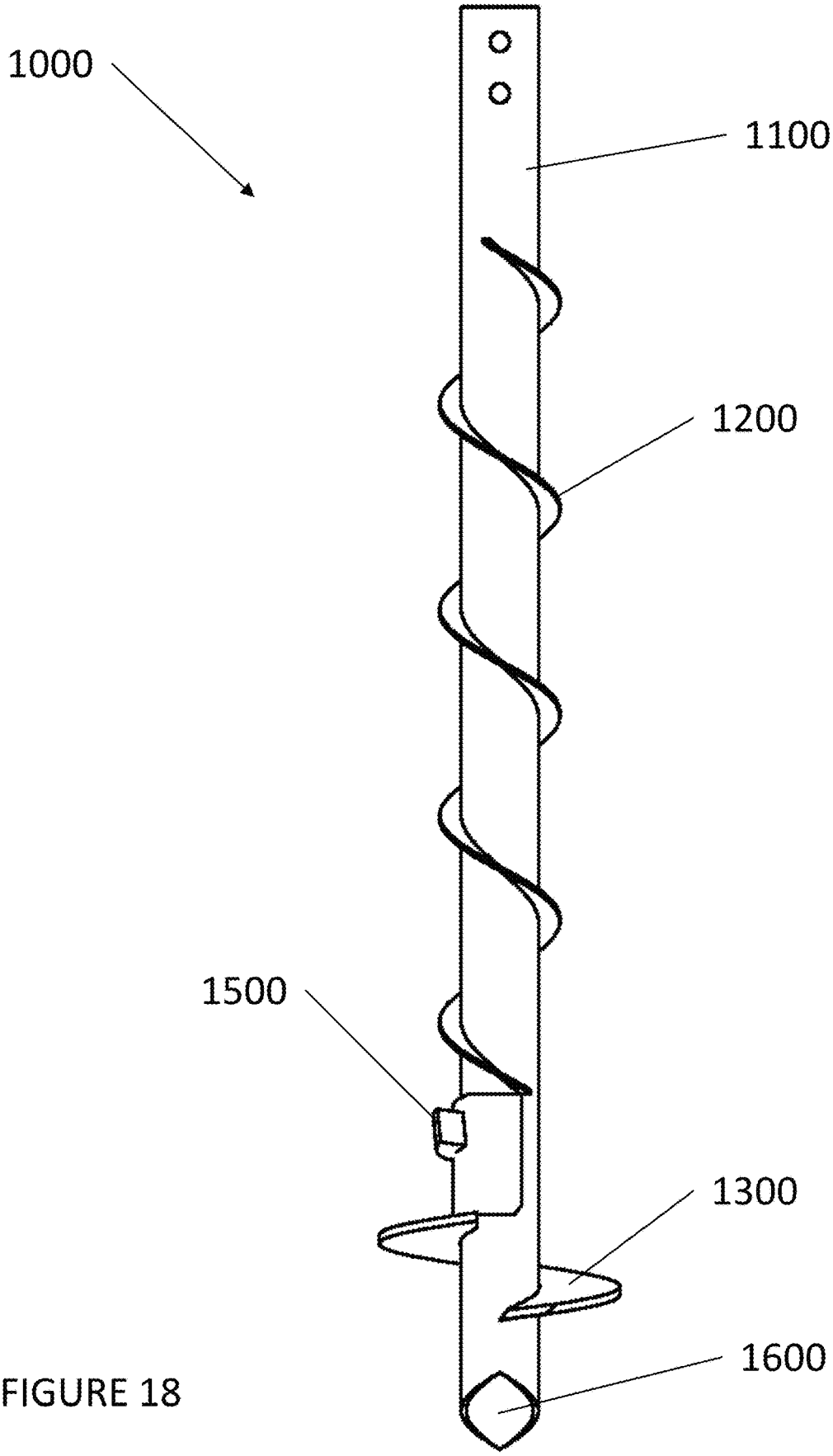
FIG. 18 illustrates a pile having an auger for providing gripping contact with a supporting medium or grout and resisting the supporting medium or grout from shearing.

FIG. 18 illustrates a pile 1000 that includes a shaft 1100. The pile 1000 includes an auger 1200. The pile 1000 has a blade 1300 that has a leading edge and a trailing edge. The leading edge of blade 1300 cuts into the soil as the pile 1000 is rotated. The pile 1000 may be equipped with a point 1600 to promote this cutting. The soil passes over blade 1300 and thereafter past trailing edge.

The pile 1000 includes a lateral compaction element 1500, located on the elongated, tubular pipe 1100 between the auger 1200 and the blade 1300. The lateral compaction element 1500 laterally compacts the loosen soil (medium) to form an annulus or core.

It is noted that auger 1200 provides a gripping interface between the supporting medium or grout and the shaft 1100, as well as, provide an interface that resists the supporting medium or grout from shearing along the surface between the supporting medium or grout and the shaft 1100.

Figure 19:
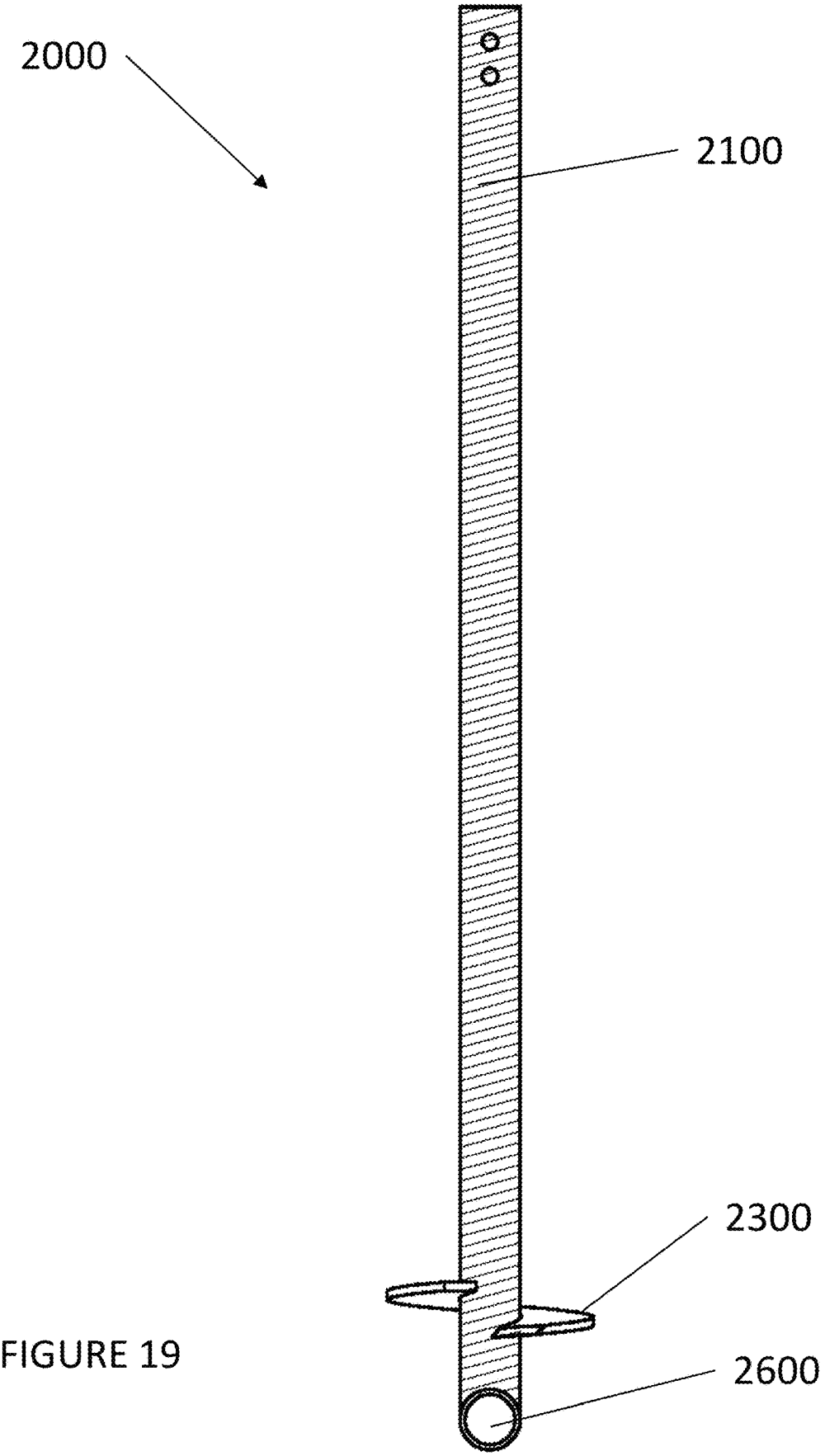
FIG. 19 illustrates another example of a pile for providing gripping contact with a supporting medium or grout and resisting the supporting medium or grout from shearing.

FIG. 19 illustrates a pile 2000 that includes a threaded shaft 2100. The pile 2000 has a blade 2300 that has a leading edge and a trailing edge. The leading edge of blade 2300 cuts into the soil as the pile 2000 is rotated. The pile 2000 may be equipped with a point 2600 to promote this cutting. The soil passes over blade 2300 and thereafter past trailing edge.

The threaded shaft 2100 provides a gripping interface between the supporting medium or grout and the threaded shaft 2100, as well as, provides an interface that resists the supporting medium or grout from shearing along the surface between the supporting medium or grout and the threaded shaft 2100.

Figure 20:
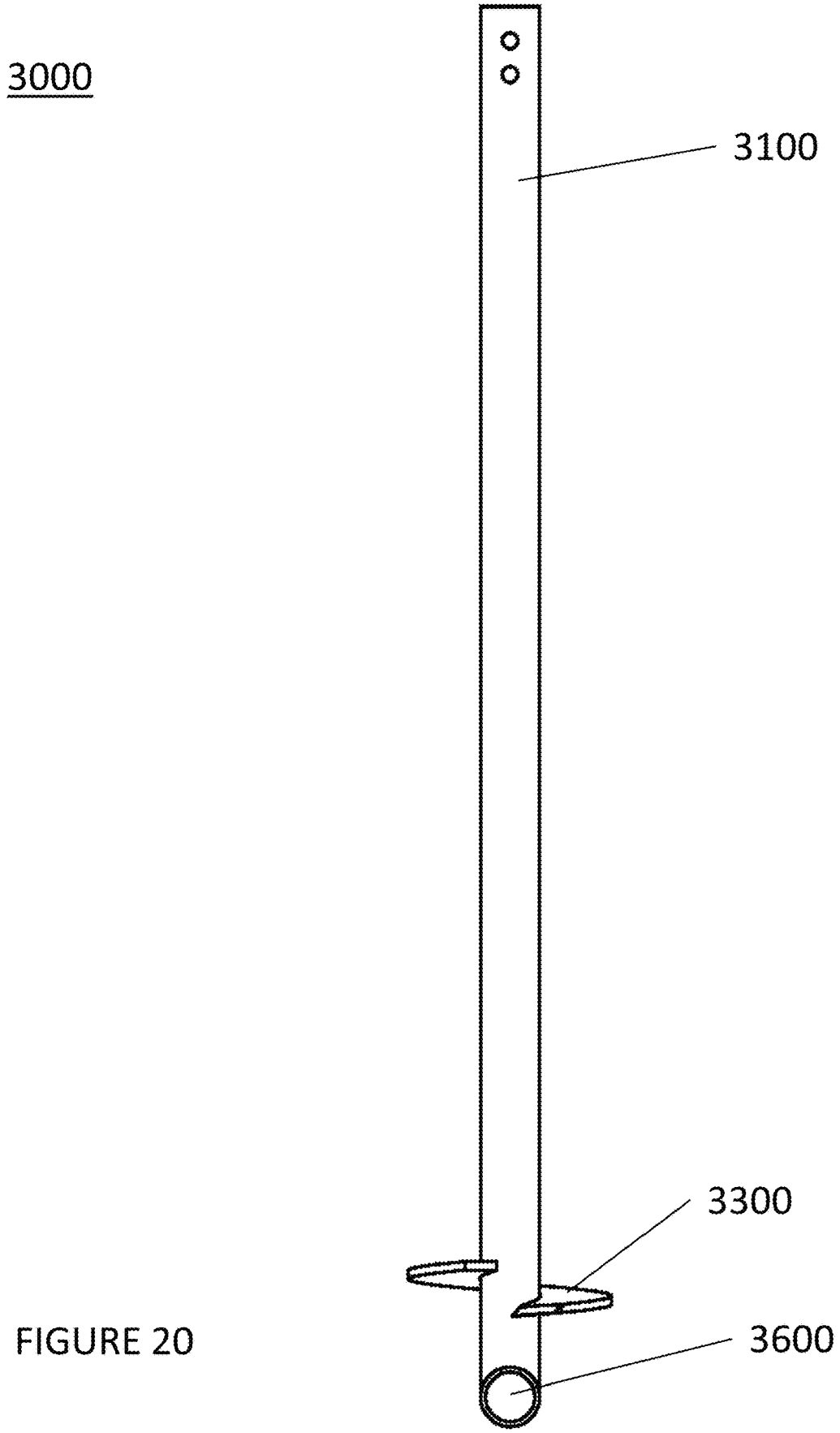
FIG. 20 illustrates a pile.

FIG. 20 illustrates a pile 3000 that includes a shaft 3100. The pile 3000 has a blade 3300 that has a leading edge and a trailing edge.

The leading edge of blade 3300 cuts into the soil as the pile 3000 is rotated. The pile 3000 may be equipped with a point 3600 to promote this cutting. The soil passes over blade 3300 and thereafter past trailing edge.

A non-helical parallel deformation, a non-helical parallel raised ring, and/or a non-helical parallel ringed channel, as used in describing the threaded shaft 300, form a plane, wherein the plane, formed by the non-helical parallel deformation, non-helical parallel raised ring, and/or non-helical parallel ringed channel, is orthogonal, in two dimensions, to a central axis of the threaded shaft 300.

On the other hand, a helical deformation (continuous raised helical thread or continuous helical channel), as used in describing the threaded shaft 300, forms a plane, wherein the plane, formed by the helical deformation (continuous raised helical thread or continuous helical channel), is not orthogonal, in two dimension, to a central axis of the threaded shaft 300

Figure 23:
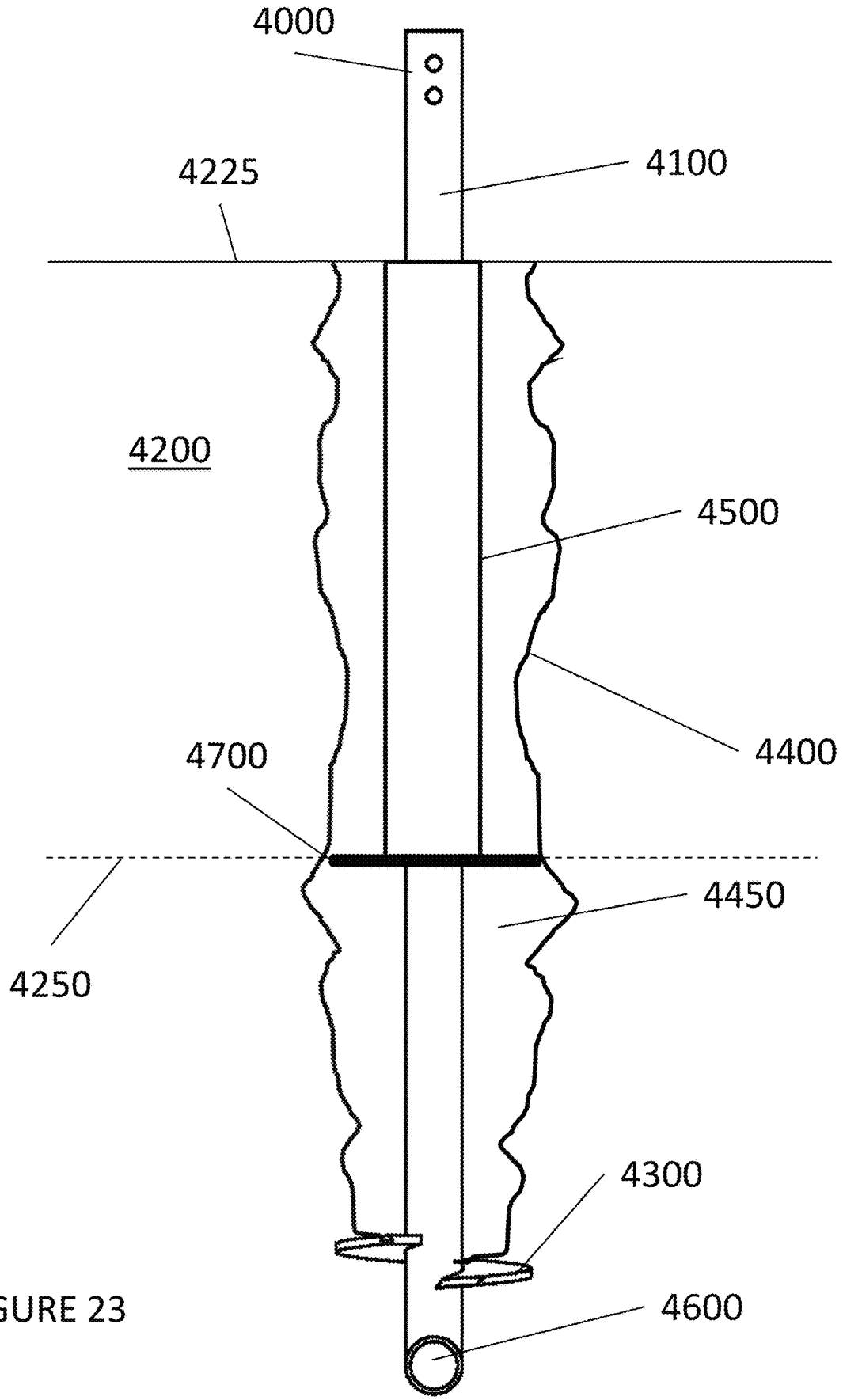
FIG. 23 illustrates a pile with an upheaval resistant sleeve and a grout disrupting plate.

The threaded shaft 300 includes helical plates 1020 formed thereon. It is noted that although FIG. 23 illustrates multiple helical plates 1020, the threaded shaft 300 may only include a single helical plate or a continuous helical plate.

The helical plates 1020 formed on the threaded shaft 300 provide resistance to prevent the supporting medium or grout from shearing along the surface between the supporting medium or grout and the threaded shaft 300. The helical plates 1020 formed on the threaded shaft 300 also provide a stronger interface (gripping) between the supporting medium or grout and the threaded shaft 300.

The leading edge 114 of helical blade 112 cuts into the soil (medium) as the pile 100 is rotated. The soil (medium) displacement head 108 may be equipped with a point 118 to promote this cutting.

The soil (medium) passes over helical blade 112 and thereafter past trailing edge 116. As the soil (medium) passes over helical blade 112, the soil (medium) is laterally compacted by lateral compaction elements 119 (lateral compaction elements 200 are discussed in more detail below with respect to FIGS. 6, 8, 10, and 12). The lateral compaction elements 119 create an annulus having outer wall 500 and void 510.

The uppermost portion of helical blade 112 may include a deformation structure 120 (located near the trailing edge 116) that displaces the soil (medium) to create a spiral groove in the outer wall 500 of the annulus.

After the pile 100 is driven into position, supporting medium or grout (not shown) may be introduced into the void 510 of the annulus. The supporting medium or grout can be introduced by means of gravity or pressure into the void 510 of the annulus.

Additionally, since the pile 100 may be a hollow tube, the supporting medium or grout can be introduced into the void 510 of the annulus through the hollow tube by means of gravity or pressure, wherein the pile 100 would include openings (not shown) that allows the supporting medium or grout to leave the pile and enter into the void 510 of the annulus.

The introduced supporting medium or grout surrounds the threaded shaft 300 of the pile 100. The threaded surface of the threaded shaft 300 of the pile 100 provides a gripping interface between the supporting medium or grout and the pile 100, as well as, provides an interface that resists the supporting medium or grout from shearing along the surface between the supporting medium or grout and the pile 100.

Figure 21:
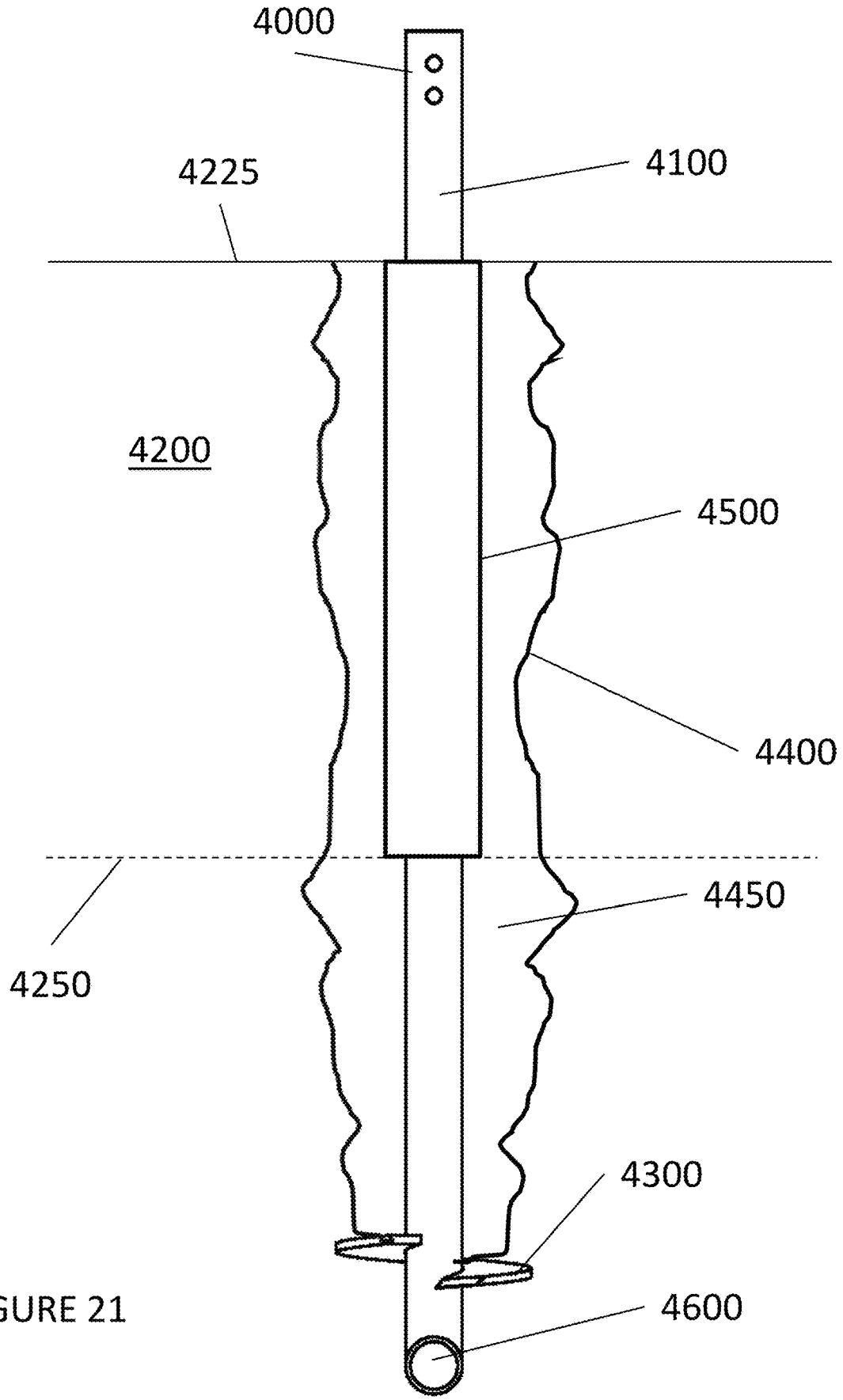
FIG. 21 illustrates a pile with an upheaval resistant sleeve.

FIG. 21 illustrates a pile 4000 that includes a shaft 4100. The pile 4000 has a helical blade 4300, at a first end, wherein the helical blade 4300 has a leading edge and a trailing edge.

The leading edge of helical blade 4300 cuts into the soil (medium) 4200 as the pile 4000 is rotated. The pile 4000 may be equipped with a point 4600 to promote this cutting. The soil (medium) 4200 passes over the helical blade 4300 and thereafter past trailing edge.

As illustrated in FIG. 21, during the driving of the pile 4000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by a lateral compaction element (not shown), as described above. Moreover, the annulus 4400 may be a deformed column formed by a lateral compaction element (not shown) and a deformation structure (not shown), as described above.

The pile 4000 further includes a frost sleeve (upheaval resistant sleeve) 4500 that surrounds shaft 4100. The frost sleeve (upheaval resistant sleeve) 4500 may be constructed of PVC, plastic, or metal. The frost sleeve (upheaval resistant sleeve) 4500 is separate from the shaft 4100. In a preferred embodiment, the inside of the frost sleeve (upheaval resistant sleeve) 4500 is covered with grease to make the installation of the frost sleeve (upheaval resistant sleeve) 4500 easier as well as provide a seal between the shaft 4100 and the frost sleeve (upheaval resistant sleeve) 4500.

The frost sleeve (upheaval resistant sleeve) 4500 is configured to provide resistance against the pile 4000 being pulled or forced upwardly out of the surrounding soil (medium). The pulling or forcing upwardly of the pile 4000 is due to upheaval forces in the surrounding soil (medium), usually triggered by freezing temperatures or frost.

The length of the frost sleeve (upheaval resistant sleeve) 4500 may be any length to provide the resistance against the pile 4000 being pulled or forced upwardly out of the surrounding soil (medium). More specifically, the length of the frost sleeve (upheaval resistant sleeve) 4500 may be long enough to cover the distance between a top of a soil (soil line) and the depth of the frost (frost line) for the area, the depth of the frost being the minimum depth in the area where one would bury a water line to avoid freezing pipes.

In one preferred embodiment, the length of the frost sleeve (upheaval resistant sleeve) 4500 is such that the frost sleeve (upheaval resistant sleeve) 4500 covers the shaft 4100 from below or at the frost line 4250 to the top 4225 of the soil (medium) 4100.

In another preferred embodiment, the frost sleeve (upheaval resistant sleeve) 4500 covers the shaft 4100 between the frost line 4250 and the top 4225 of the soil (medium) 4200.

In another preferred embodiment, the frost sleeve (upheaval resistant sleeve) 4500 covers the shaft 4100 from below the frost line 4250 and to below the top 4225 of the soil (medium) 4200.

The pile 4000 of FIG. 21 may be used in a solar frame foundation where the pile 4000 is not required to support a large vertical weight or force. However, the pile 4000 of FIG. 21, depending on the environment, may be driven to a depth wherein the pile 4000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 4000 of FIG. 21 from being forced or pulled upwardly by the surrounding soil (medium) during times of frost or freezing temperature (frost upheaval).

Figure 22:
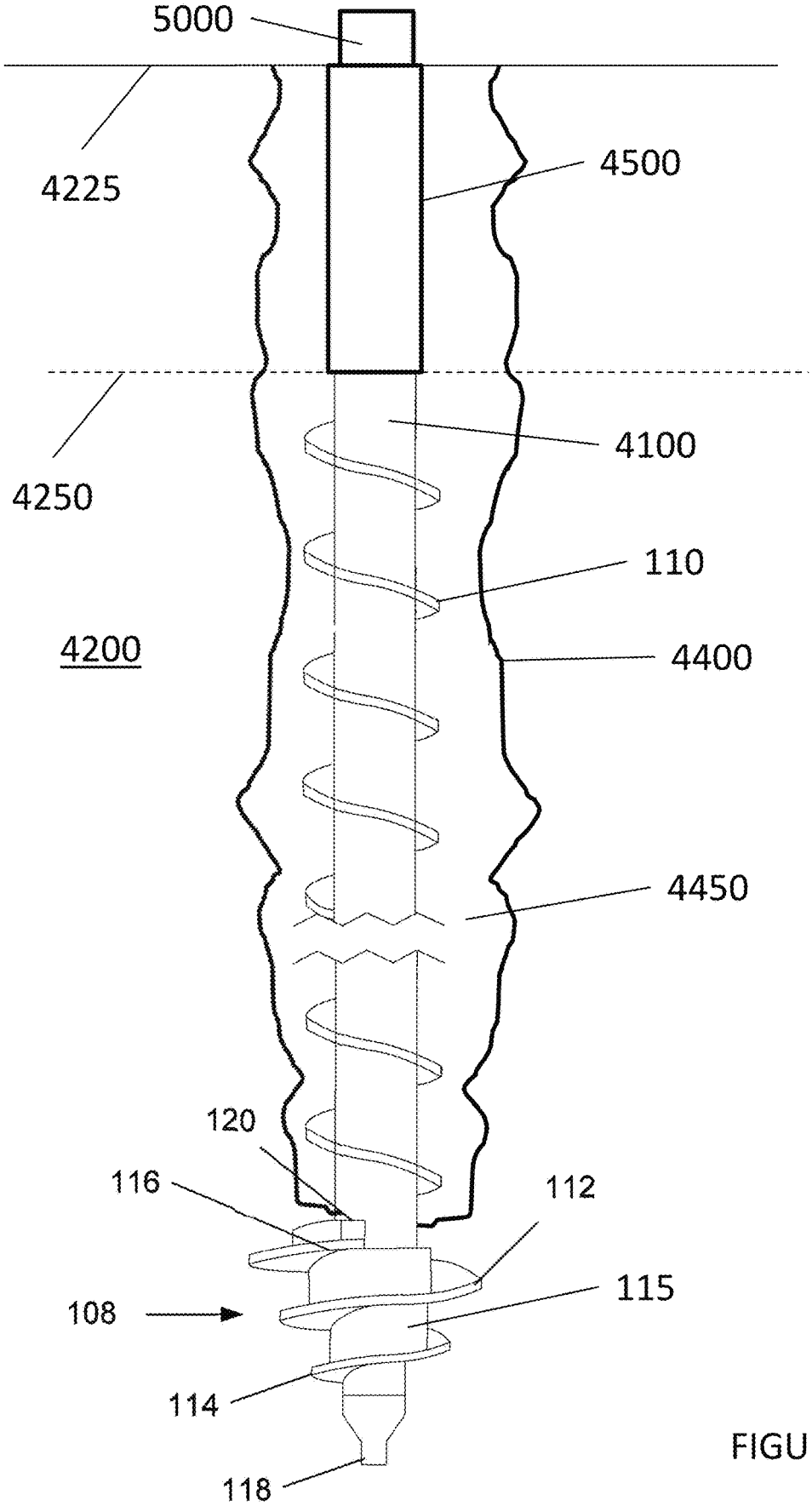
FIG. 22 illustrates another pile with an upheaval resistant sleeve.

FIG. 22 illustrates an auger grouted pile 5000 includes an elongated, tubular shaft 4100 with a hollow central chamber, a top section, and a bottom section. The bottom section includes a soil (medium) displacement head 108. The top section includes a reverse auger 110. Soil (medium) displacement head 108 has a helical blade 112 that has a leading edge 114 and a trailing edge 116.

The leading edge 114 of helical blade 112 cuts into the soil (medium) 4200 as the pile is rotated into the soil (medium) 4200 at such contact point. The soil (medium) displacement head 108 may be equipped with a point 118 to promote this cutting.

The soil (medium) 4200 passes over helical blade 112 and thereafter past trailing edge 116. The auger grouted pile 5000 includes a lateral compaction member 115 to compact the soil (medium) 4200 and create an annulus 4400. The uppermost portion of helical blade 112 includes an optional deformation structure 120 that displaces the soil (medium) 4200 to create irregularities in the annulus 4400 formed by the lateral compaction element 115.

As illustrated in FIG. 22, during the driving of the pile 5000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by the lateral compaction element 115. Moreover, the annulus 4400 may be a deformed column formed by a lateral compaction element 115 and a deformation structure 120.

The pile 5000 further includes a frost sleeve (upheaval resistant sleeve) 4500 that surrounds shaft 4100. The frost sleeve (upheaval resistant sleeve) 4500 may be constructed of PVC, plastic, or metal. The frost sleeve (upheaval resistant sleeve) 4500 is separate from the shaft 4100. In a preferred embodiment, the inside of the frost sleeve (upheaval resistant sleeve) 4500 is covered with grease to make the installation of the frost sleeve (upheaval resistant sleeve) 4500 easier as well as provide a seal between the shaft 4100 and the frost sleeve (upheaval resistant sleeve) 4500.

The frost sleeve (upheaval resistant sleeve) 4500 is configured to provide resistance against the pile 4000 being pulled or forced upwardly out of the surrounding soil (medium). The pulling or forcing upwardly of the pile 4000 is due to upheaval forces in the surrounding soil (medium), usually triggered by freezing temperatures or frost.

The length of the frost sleeve (upheaval resistant sleeve) 4500 may be any length to provide the resistance against the pile 4000 being pulled or forced upwardly out of the surrounding soil (medium).

In one preferred embodiment, the length of the frost sleeve (upheaval resistant sleeve) 4500 is such that the frost sleeve (upheaval resistant sleeve) 4500 covers the shaft 4100 from below or at the frost line 4250 to the top 4225 of the soil (medium) 4100.

In another preferred embodiment, the frost sleeve (upheaval resistant sleeve) 4500 covers the shaft 4100 between the frost line 4250 and the top 4225 of the soil (medium) 4200.

In another preferred embodiment, the frost sleeve (upheaval resistant sleeve) 4500 covers the shaft 4100 from below the frost line 4250 and to below the top 4225 of the soil (medium) 4200.

The pile 5000 of FIG. 22 may be used in a solar frame foundation where the pile 5000 is not required to support a large vertical weight or force. However, the pile 5000 of FIG. 22, depending on the environment, may be driven to a depth wherein the pile 5000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 5000 of FIG. 22 from being forced or pulled upwardly by the surrounding soil (medium) during times of frost or freezing temperature (frost upheaval).

FIG. 23 illustrates a pile 4000 that includes a shaft 4100. The pile 4000 has a helical blade 4300, at a first end, wherein the helical blade 4300 has a leading edge and a trailing edge.

The leading edge of helical blade 4300 cuts into the soil (medium) 4200 as the pile 4000 is rotated. The pile 4000 may be equipped with a point 4600 to promote this cutting. The soil (medium) 4200 passes over the helical blade 4300 and thereafter past trailing edge.

As illustrated in FIG. 23, during the driving of the pile 4000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by a lateral compaction element (not shown), as described above. Moreover, the annulus 4400 may be a deformed column formed by a lateral compaction element (not shown) and a deformation structure (not shown), as described above.

The pile 4000 further includes a frost sleeve (upheaval resistant sleeve) 4500 that surrounds shaft 4100. The frost sleeve (upheaval resistant sleeve) 4500 may be constructed of PVC, plastic, or metal. The frost sleeve (upheaval resistant sleeve) 4500 is separate from the shaft 4100. In a preferred embodiment, the inside of the frost sleeve (upheaval resistant sleeve) 4500 is covered with grease to make the installation of the frost sleeve (upheaval resistant sleeve) 4500 easier as well as provide a seal between the shaft 4100 and the frost sleeve (upheaval resistant sleeve) 4500.

The frost sleeve (upheaval resistant sleeve) 4500 is configured to provide resistance against the pile 4000 being pulled or forced upwardly out of the surrounding soil (medium). The pulling or forcing upwardly of the pile 4000 is due to upheaval forces in the surrounding soil (medium), usually triggered by freezing temperatures or frost.

The length of the frost sleeve (upheaval resistant sleeve) 4500 may be any length to provide the resistance against the pile 4000 being pulled or forced upwardly out of the surrounding soil (medium).

In one preferred embodiment, the length of the frost sleeve (upheaval resistant sleeve) 4500 is such that the frost sleeve (upheaval resistant sleeve) 4500 covers the shaft 4100 from below or at the frost line 4250 to the top 4225 of the soil (medium) 4100.

In another preferred embodiment, the frost sleeve (upheaval resistant sleeve) 4500 covers the shaft 4100 between the frost line 4250 and the top 4225 of the soil (medium) 4200.

In another preferred embodiment, the frost sleeve (upheaval resistant sleeve) 4500 covers the shaft 4100 from below the frost line 4250 and to below the top 4225 of the soil (medium) 4200.

The pile 4000 further includes a grout disrupting plate 4700 which is located right below the frost sleeve (upheaval resistant sleeve) 4500. The grout disrupting plate 4700 may be constructed of PVC, plastic, or metal. In one embodiment, the grout disrupting plate 4700 may be attached to the frost sleeve (upheaval resistant sleeve) 4500. Alternatively, the grout disrupting plate 4700 is not attached to the frost sleeve (upheaval resistant sleeve) 4500.

The grout disrupting plate 4700 creates a disruption in the grout 4450 such that during time of frost upheaval, the grout 4450 above the grout disrupting plate 4700 (above the frost line 4250) will separate from the grout 4450 below the grout disrupting plate 4700 (below the frost line 4250), thereby leaving the grout 4450 below the grout disrupting plate 4700 (below the frost line 4250) intact to provide lateral support for the pile 4000. The grout 4450 above the grout disrupting plate 4700 (above the frost line 4250) still provide some lateral support for the pile 4000, but the main lateral support will be provided by the undisturbed grout 4450 below the grout disrupting plate 4700 (below the frost line 4250).

The pile 4000 of FIG. 23 may be used in a solar frame foundation where the pile 4000 is not required to support a large vertical weight or force. However, the pile 4000 of FIG. 23, depending on the environment, may be driven to a depth wherein the pile 4000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 4000 of FIG. 23 from being forced or pulled upwardly by the surrounding soil (medium) during times of frost or freezing temperature (frost upheaval).

Figure 24:
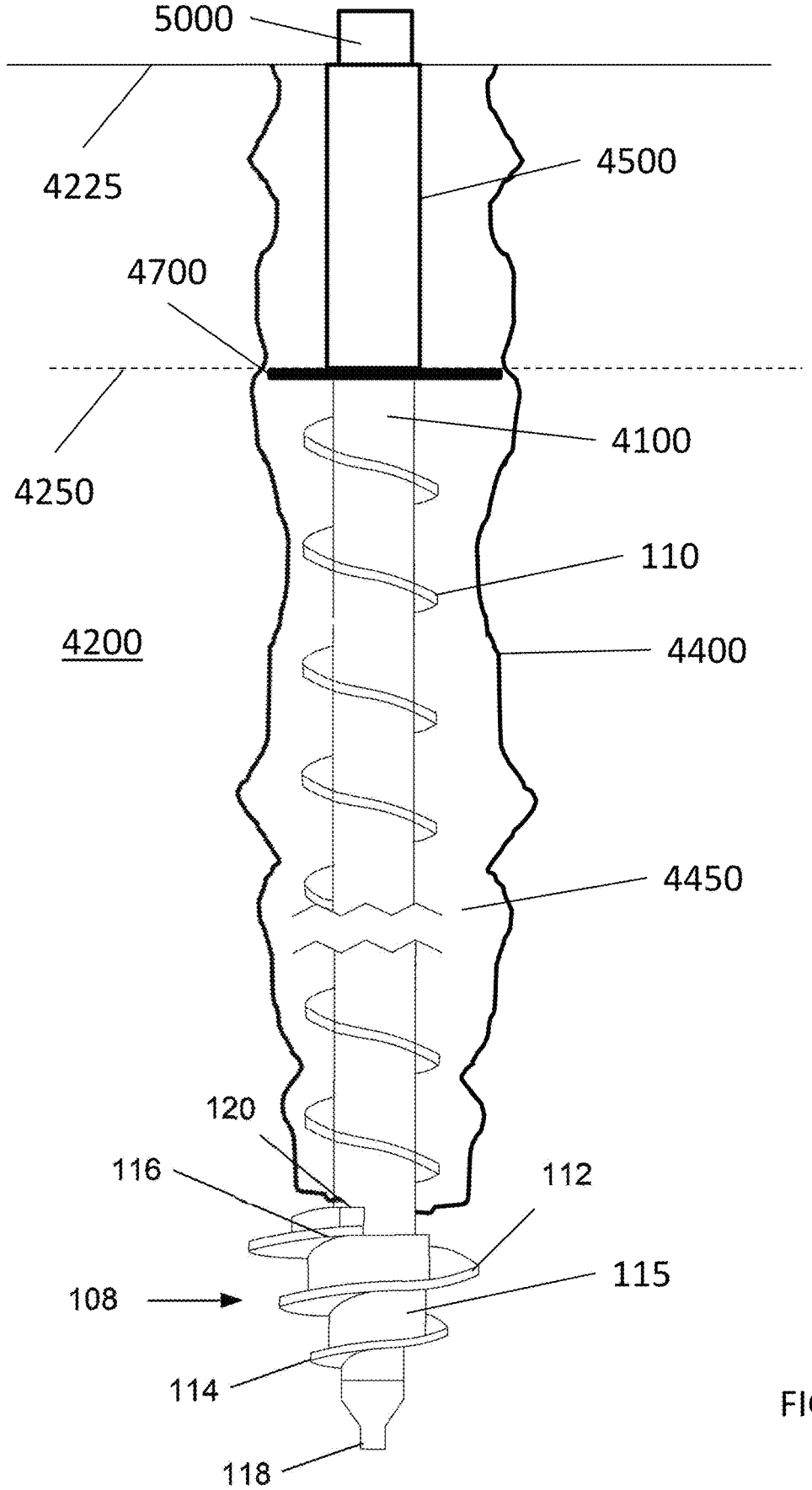
FIG. 24 illustrates another pile with an upheaval resistant sleeve and a grout disrupting plate.

FIG. 24 illustrates an auger grouted pile 5000 includes an elongated, tubular shaft 4100 with a hollow central chamber, a top section, and a bottom section. The bottom section includes a soil (medium) displacement head 108. The top section includes a reverse auger 110. Soil (medium) displacement head 108 has a helical blade 112 that has a leading edge 114 and a trailing edge 116.

The leading edge 114 of helical blade 112 cuts into the soil (medium) 4200 as the pile is rotated into the soil (medium) 4200 at such contact point. The soil (medium) displacement head 108 may be equipped with a point 118 to promote this cutting.

The soil (medium) 4200 passes over helical blade 112 and thereafter past trailing edge 116. The auger grouted pile 5000 includes a lateral compaction member 115 to compact the soil (medium) 4200 and create an annulus 4400. The uppermost portion of helical blade 112 includes an optional deformation structure 120 that displaces the soil (medium) 4200 to create irregularities in the annulus 4400 formed by the lateral compaction element 115.

As illustrated in FIG. 24, during the driving of the pile 5000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by the lateral compaction element 115. Moreover, the annulus 4400 may be a deformed column formed by a lateral compaction element 115 and a deformation structure 120.

The pile 5000 further includes a frost sleeve (upheaval resistant sleeve) 4500 that surrounds shaft 4100. The frost sleeve (upheaval resistant sleeve) 4500 may be constructed of PVC, plastic, or metal. The frost sleeve (upheaval resistant sleeve) 4500 is separate from the shaft 4100. In a preferred embodiment, the inside of the frost sleeve (upheaval resistant sleeve) 4500 is covered with grease to make the installation of the frost sleeve (upheaval resistant sleeve) 4500 easier as well as provide a seal between the shaft 4100 and the frost sleeve (upheaval resistant sleeve) 4500.

The frost sleeve (upheaval resistant sleeve) 4500 is configured to provide resistance against the pile 4000 being pulled or forced upwardly out of the surrounding soil (medium). The pulling or forcing upwardly of the pile 4000 is due to upheaval forces in the surrounding soil (medium), usually triggered by freezing temperatures or frost.

The length of the frost sleeve (upheaval resistant sleeve) 4500 may be any length to provide the resistance against the pile 4000 being pulled or forced upwardly out of the surrounding soil (medium).

In one preferred embodiment, the length of the frost sleeve (upheaval resistant sleeve) 4500 is such that the frost sleeve (upheaval resistant sleeve) 4500 covers the shaft 4100 from below or at the frost line 4250 to the top 4225 of the soil (medium) 4100.

In another preferred embodiment, the frost sleeve (upheaval resistant sleeve) 4500 covers the shaft 4100 between the frost line 4250 and the top 4225 of the soil (medium) 4200.

In another preferred embodiment, the frost sleeve (upheaval resistant sleeve) 4500 covers the shaft 4100 from below the frost line 4250 and to below the top 4225 of the soil (medium) 4200.

The pile 5000 further includes a grout disrupting plate 4700 which is located right below the frost sleeve (upheaval resistant sleeve) 4500. The grout disrupting plate 4700 may be constructed of PVC, plastic, or metal. In one embodiment, the grout disrupting plate 4700 may be attached to the frost sleeve (upheaval resistant sleeve) 4500. Alternatively, the grout disrupting plate 4700 is not attached to the frost sleeve (upheaval resistant sleeve) 4500.

The grout disrupting plate 4700 creates a disruption in the grout 4450 such that during time of frost upheaval, the grout 4450 above the grout disrupting plate 4700 (above the frost line 4250) will separate from the grout 4450 below the grout disrupting plate 4700 (below the frost line 4250), thereby leaving the grout 4450 below the grout disrupting plate 4700 (below the frost line 4250) intact to provide lateral support for the pile 5000. The grout 4450 above the grout disrupting plate 4700 (above the frost line 4250) still provide some lateral support for the pile 5000, but the main lateral support will be provided by the undisturbed grout 4450 below the grout disrupting plate 4700 (below the frost line 4250).

The pile 5000 of FIG. 24 may be used in a solar frame foundation where the pile 5000 is not required to support a large vertical weight or force. However, the pile 5000 of FIG. 24, depending on the environment, may be driven to a depth wherein the pile 5000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 5000 of FIG. 24 from being forced or pulled upwardly by the surrounding soil (medium) during times of frost or freezing temperature (frost upheaval).

Figure 25:
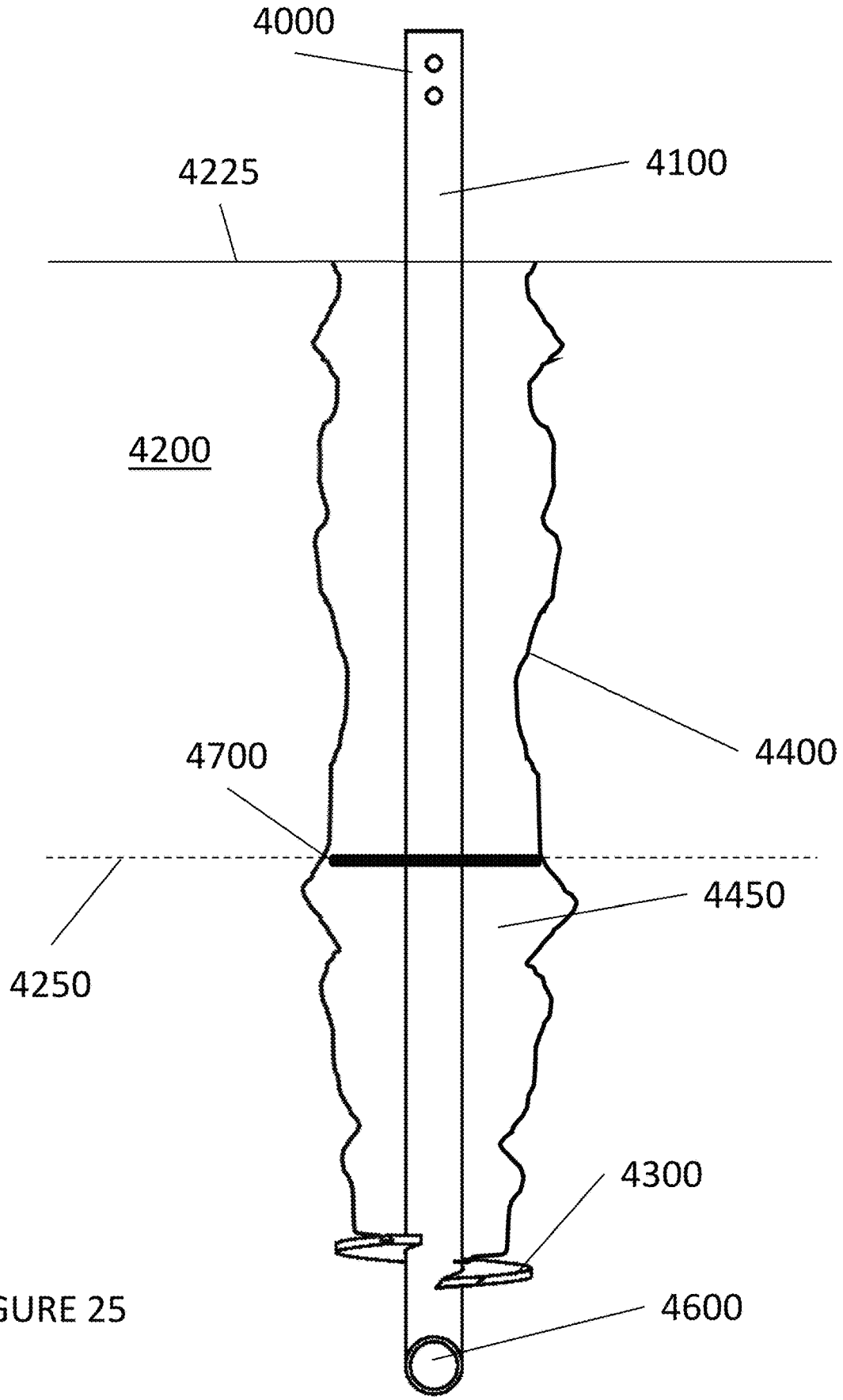
FIG. 25 illustrates a pile with a grout disrupting plate.

FIG. 25 illustrates a pile 4000 that includes a shaft 4100. The pile 4000 has a helical blade 4300, at a first end, wherein the helical blade 4300 has a leading edge and a trailing edge.

The leading edge of helical blade 4300 cuts into the soil (medium) 4200 as the pile 4000 is rotated. The pile 4000 may be equipped with a point 4600 to promote this cutting. The soil (medium) 4200 passes over the helical blade 4300 and thereafter past trailing edge.

As illustrated in FIG. 25, during the driving of the pile 4000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by a lateral compaction element (not shown), as described above. Moreover, the annulus 4400 may be a deformed column formed by a lateral compaction element (not shown) and a deformation structure (not shown), as described above.

The pile 4000 further includes a grout disruption (separation) plate 4700 which is located right below frost sleeve (upheaval resistant sleeve) 4500. The grout disruption (separation) plate 4700 may be constructed of PVC, plastic, or metal. In one embodiment, the grout disruption (separation) plate 4700 may be attached to the pile 4000. Alternatively, the grout disruption (separation) plate 4700 is not attached to the pile 4000.

The grout disrupting plate 4700 creates a disruption in the grout 4450 such that during time of frost upheaval, the grout 4450 above the grout disruption (separation) plate 4700 (above the frost line 4250) will separate from the grout 4450 below the grout disruption (separation) plate 4700 (below the frost line 4250), thereby leaving the grout 4450 below the grout disruption (separation) plate 4700 (below the frost line 4250) intact to provide lateral support for the pile 4000. The grout 4450 above the grout disruption (separation) plate 4700 (above the frost line 4250) still provide some lateral support for the pile 4000, but the main lateral support will be provided by the undisturbed grout 4450 below the grout disruption (separation) plate 4700 (below the frost line 4250).

The pile 4000 of FIG. 25 may be used in a solar frame foundation where the pile 4000 is not required to support a large vertical weight or force. However, the pile 4000 of FIG. 25, depending on the environment, may be driven to a depth wherein the pile 4000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 4000 of FIG. 25 from being forced or pulled upwardly by the surrounding soil (medium) during times of frost or freezing temperature (frost upheaval).

Figure 26:
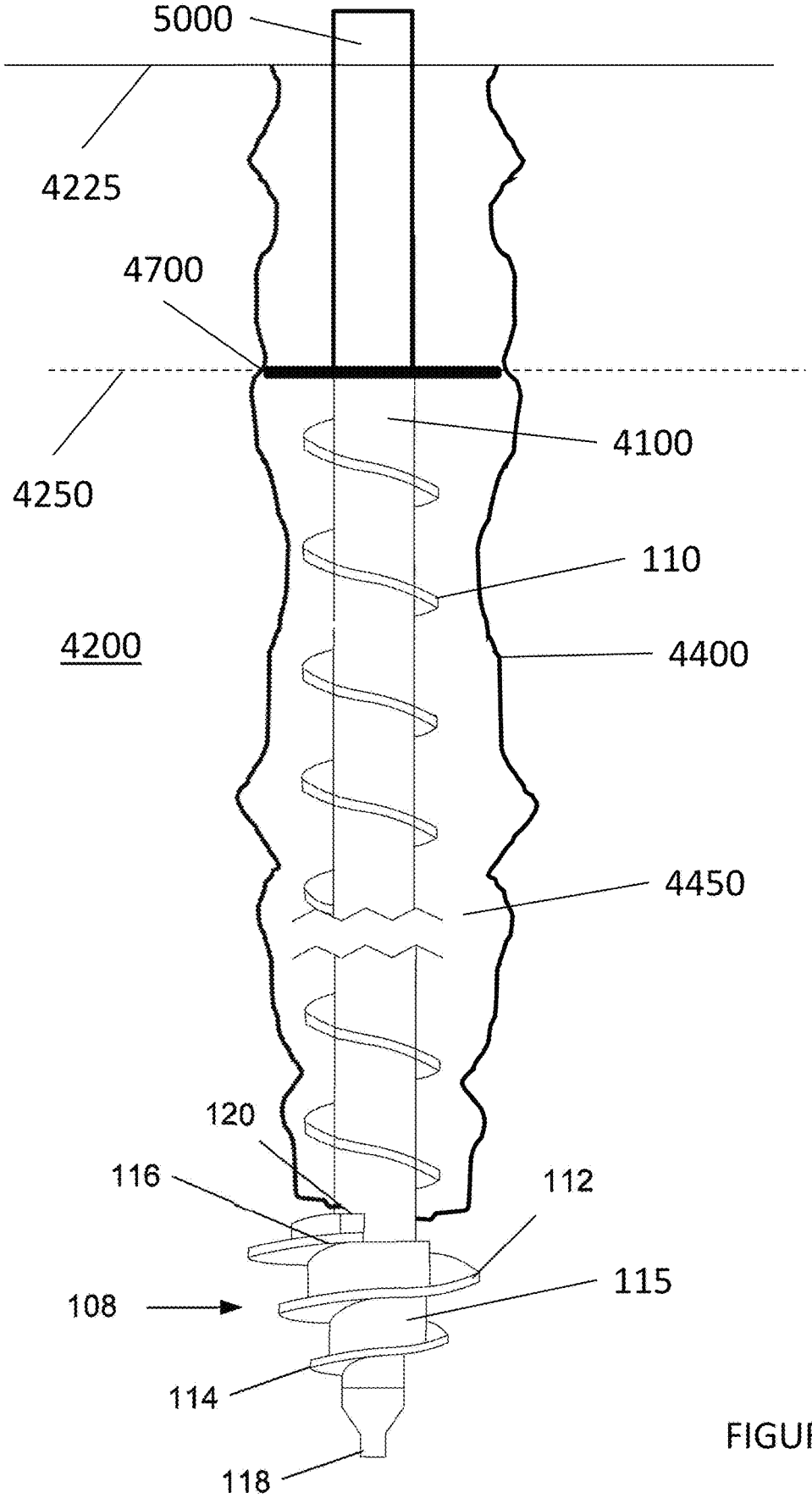
FIG. 26 illustrates another pile with a grout disrupting plate.

FIG. 26 illustrates an auger grouted pile 5000 includes an elongated, tubular shaft 4100 with a hollow central chamber, a top section, and a bottom section. The bottom section includes a soil (medium) displacement head 108. The top section includes a reverse auger 110. Soil (medium) displacement head 108 has a helical blade 112 that has a leading edge 114 and a trailing edge 116.

The leading edge 114 of helical blade 112 cuts into the soil (medium) 4200 as the pile is rotated into the soil (medium) 4200 at such contact point. The soil (medium) displacement head 108 may be equipped with a point 118 to promote this cutting.

The soil (medium) 4200 passes over helical blade 112 and thereafter past trailing edge 116. The auger grouted pile 5000 includes a lateral compaction member 115 to compact the soil (medium) 4200 and create an annulus 4400. The uppermost portion of helical blade 112 includes an optional deformation structure 120 that displaces the soil (medium) 4200 to create irregularities in the annulus 4400 formed by the lateral compaction element 115.

As illustrated in FIG. 26, during the driving of the pile 5000 into the soil (medium) 4200, an annulus 4400 is created around the shaft 4100, which may be filled with supporting medium 4450. The supporting medium 4450 may be grout. The supporting medium 4450 provides the pile 4000 with lateral strength (resistance against horizontal forces acting upon the pile 4000).

The annulus 4400 may be a column formed by the lateral compaction element 115. Moreover, the annulus 4400 may be a deformed column formed by a lateral compaction element 115 and a deformation structure 120.

The pile 5000 further includes a grout disruption (separation) plate 4700 which is located right below the frost sleeve (upheaval resistant sleeve) 4500. The grout disruption (separation) plate 4700 is not attached to the pile 5000.

The grout disruption (separation) plate 4700 creates a disruption in the grout 4450 such that during time of frost upheaval, the grout 4450 above the grout disrupting plate 4700 (above the frost line 4250) will separate from the grout 4450 below the grout disrupting plate 4700 (below the frost line 4250), thereby leaving the grout 4450 below the grout disruption (separation) plate 4700 (below the frost line 4250) intact to provide lateral support for the pile 5000. The grout 4450 above the grout disruption (separation) plate 4700 (above the frost line 4250) still provide some lateral support for the pile 5000, but the main lateral support will be provided by the undisturbed grout 4450 below the grout disruption (separation) plate 4700 (below the frost line 4250).

The pile 5000 of FIG. 26 may be used in a solar frame foundation where the pile 5000 is not required to support a large vertical weight or force. However, the pile 5000 of FIG. 26, depending on the environment, may be driven to a depth wherein the pile 5000 can be forced or pulled upwardly by the surrounding soil (medium) during times of frost or freezing temperature (frost upheaval). The frost sleeve (upheaval resistant sleeve) 4500 provides the resistance to the upheaval forces, thereby preventing the pile 5000 of FIG. 26 from being forced or pulled upwardly by the surrounding soil (medium) during times of frost or freezing temperature (frost upheaval).

Figure 27:
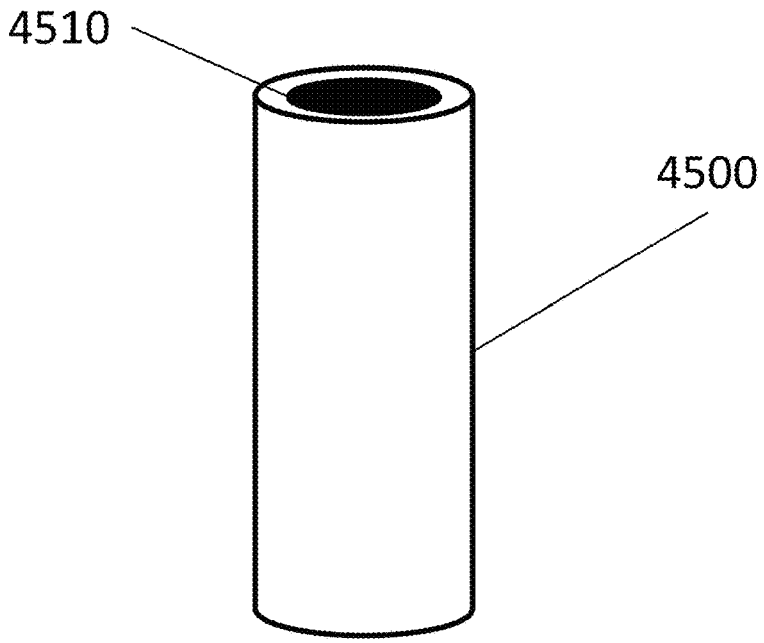
FIG. 27 illustrates a side view of an upheaval resistant sleeve.

FIG. 27 illustrates a side view of an upheaval resistant sleeve. As illustrated in FIG. 27, a frost sleeve (upheaval resistant sleeve) 4500 is cylindrical in shape and has an opening 4510 at a top end and an opening (not shown) at a bottom end. The opening 4510 at a top end and the opening (not shown) at a bottom end are configured to enable the frost sleeve (upheaval resistant sleeve) 4500 to slide over a pile and be placed between a top of a soil and a frost line.

Figure 28:
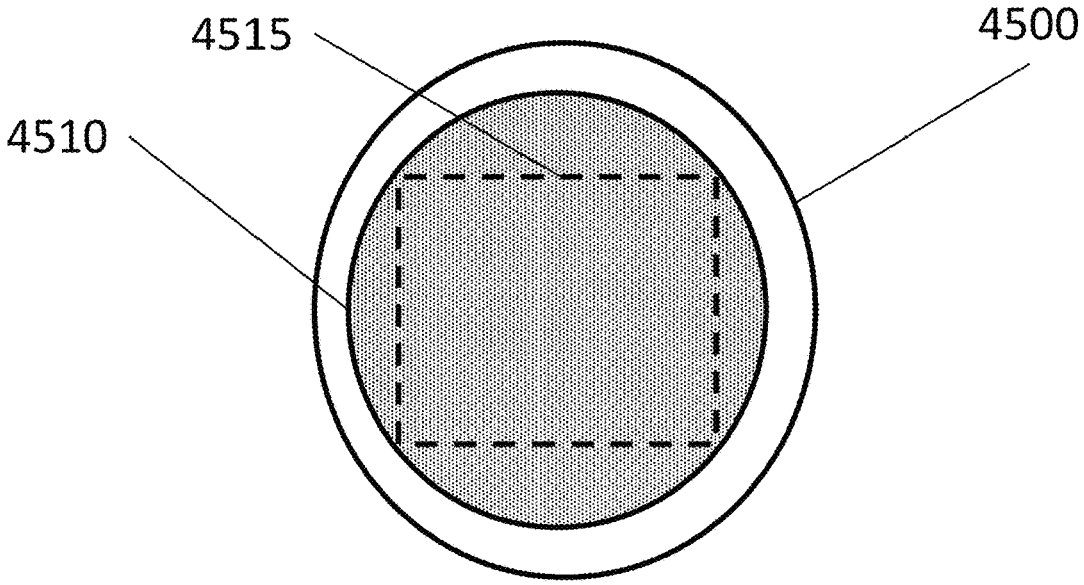
FIG. 28 illustrates a top view of the upheaval resistant sleeve of FIG. 27.
Figure 29:
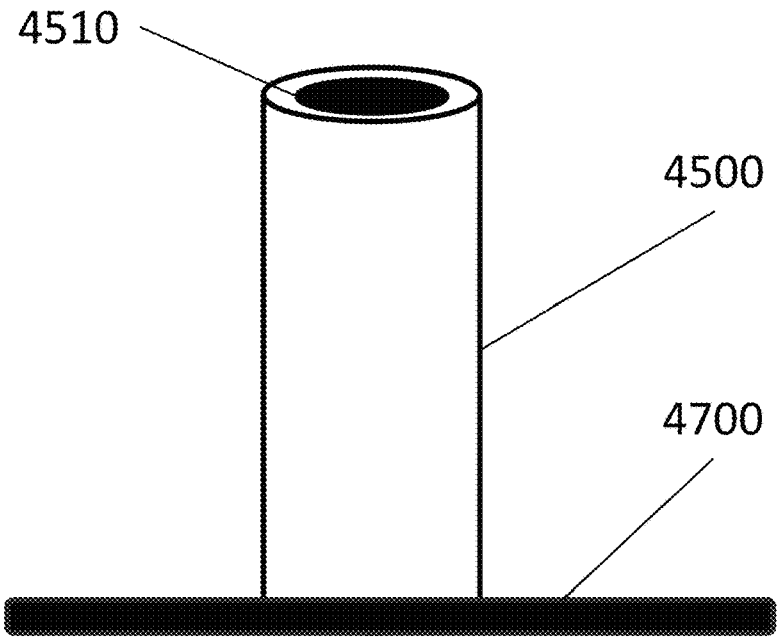
FIG. 29 illustrates an upheaval resistant sleeve and a grout disrupting plate.
Figure 30:
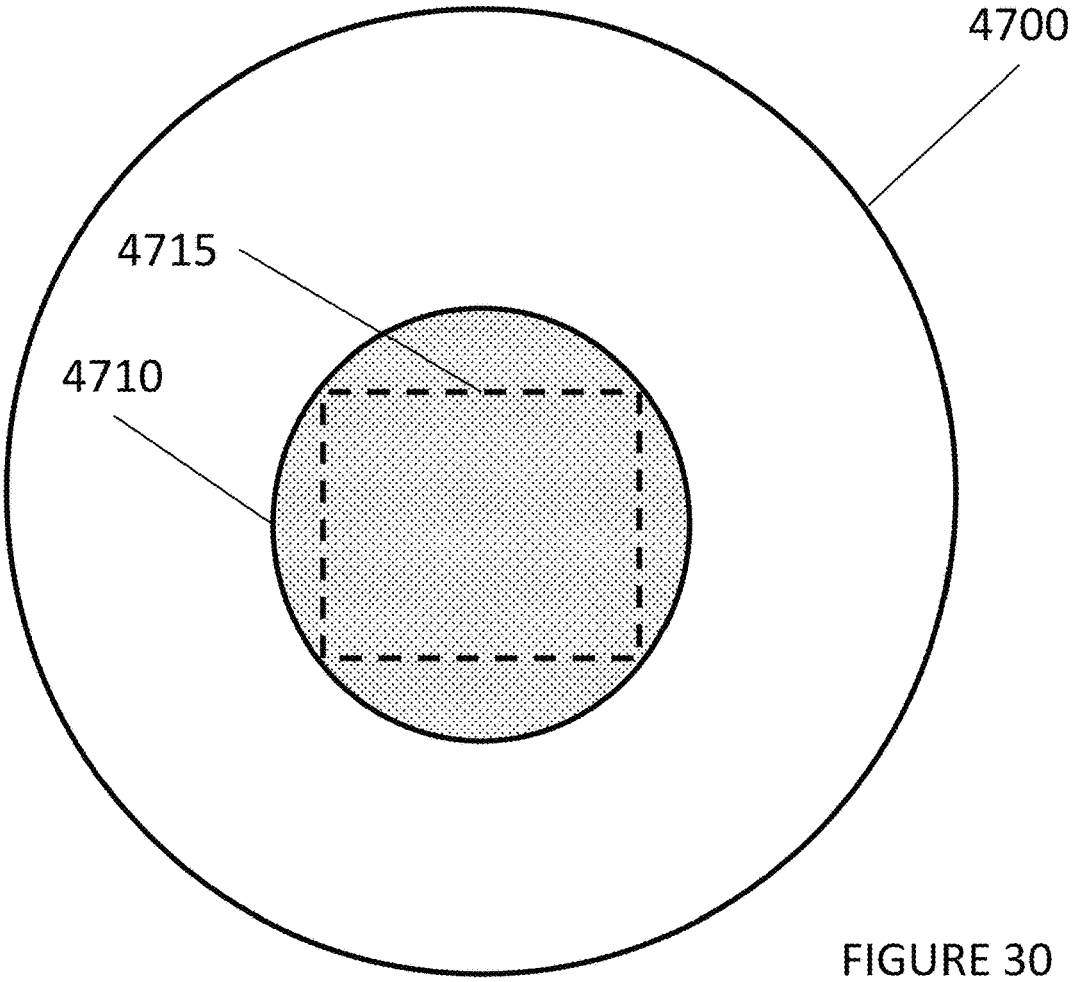
FIG. 30 illustrates a top view of a grout disrupting plate.

FIG. 28 illustrates a top view of the upheaval resistant sleeve of FIG. 27;

FIG. 29 illustrates an upheaval resistant sleeve and a grout disrupting plate; and FIG. 30 illustrates a top view of a grout disrupting plate.

In the various embodiments described above, the shaft may be a solid bar, a solid pipe, a hollow bar, or a hollow pipe. Moreover, in the various embodiments described above, the shaft may be round, rectangular, or square.

In the various embodiments described above, the supporting medium may be grout.

In the various embodiments described above, the embodiments are applicable to a displacement pile and/or a helical pile.

A pile includes a shaft and a soil displacement head, operatively connected to a first end of the shaft, having a helical blade with a leading edge and a trailing edge; the shaft having deformations formed thereon to provide a gripping interface between a supporting medium or grout and the pile.

The deformations may be threads. The threads may be formed on the entire length of the shaft.

The deformations may be a plurality of projections (protrusions) projecting away from the shaft. The deformations may be a plurality of indentations projecting into the shaft. The deformations may be a plurality of indentations projecting into the shaft and a plurality of projections (protrusions) projecting away from the shaft.

The pile may include a lateral compaction element, located within the helical blade to laterally compact a medium, as the pile is driven into the medium, to create an annulus in the medium. The pile may include a deformation structure disposed above the lateral compaction element to create a spiral deformation in an outer wall of the annulus.

A pile for being driven into soil comprises a shaft and a frost sleeve surrounding the shaft; the frost sleeve being located on the shaft between a top of the soil and a frost line.

The frost sleeve may have a length equal to a distance between the top of the soil and the frost line. The frost sleeve may have a length greater than a distance between the top of the soil and the frost line.

The frost sleeve may be constructed of PVC. The frost sleeve may be constructed of metal.

The pile may further comprise grease located between the shaft and the frost sleeve.

The pile may further comprise a grout disruption plate; the grout disruption plate being located at the frost line.

The grout disruption plate may be attached to the frost sleeve.

The grout disruption plate may be constructed of PVC. The grout disruption plate may be constructed of metal.

A pile for being placed in a supporting medium comprises an pile shaft; a helical blade, operatively connected to the pile shaft, having a leading edge and a trailing edge and configured to move the pile into the supporting medium; a lateral compaction protrusion, formed on the pile shaft, to create an annulus within the supporting medium, the annulus, created by the lateral compaction protrusion, having a diameter greater than a diameter of the pile shaft; and a frost sleeve surrounding the pile shaft; the frost sleeve being located on the shaft between a top of the soil and a frost line.

The frost sleeve may have a length equal to a distance between the top of the soil and the frost line. The frost sleeve may have a length greater than a distance between the top of the soil and the frost line.

The frost sleeve may be constructed of PVC. The frost sleeve may be constructed of metal.

The pile may further comprise grease located between the shaft and the frost sleeve.

The pile may further comprise a grout disruption plate; the grout disruption plate being located at the frost line.

The grout disruption plate may be attached to the frost sleeve.

The grout disruption plate may be constructed of PVC. The grout disruption plate may be constructed of metal.

A device for preventing a grout supported pile, driven into a soil, from experiencing frost induced upheavals, comprises a frost sleeve configured to surround a shaft of the grout supported pile and to allow movement of the cylindrical frost sleeve with respect to the shaft.

The frost sleeve may have a length equal to a distance between the top of the soil and the frost line. The frost sleeve may have a length greater than a distance between the top of the soil and the frost line.

The frost sleeve may be constructed of PVC. The frost sleeve may be constructed of metal.

The pile may further comprise grease located between the shaft and the frost sleeve.

The pile may further comprise a grout disruption plate, the grout disruption plate being located at the frost line.

The grout disruption plate may be attached to the frost sleeve.

The grout disruption plate may be constructed of PVC. The grout disruption plate may be constructed of metal.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the above description.

What is claimed is:

1. A pile for being driven into soil, comprising:

a shaft;

a frost sleeve surrounding said shaft; and a grout disruption plate;

said grout disruption plate being located at the frost line;

said grout disruption plate being unattached to said frost sleeve;

said frost sleeve being located on said shaft between a top of the soil and a frost line;

said frost sleeve being unattached to said shaft;

said grout disruption plate being configured to form a disruption between grout surrounding said shaft above the frost line and grout surrounding said shaft below the frost line;

said grout disruption plate being configured to provide lateral support for said shaft below the frost line.

2. The pile as claimed in claim 1, wherein said frost sleeve has a length equal to a distance between the top of the soil and the frost line.

3. The pile as claimed in claim 1, wherein said frost sleeve has a length greater than a distance between the top of the soil and the frost line.

4. The pile as claimed in claim 1, wherein said frost sleeve is constructed of PVC.

5. The pile as claimed in claim 1, wherein said frost sleeve is constructed of metal.

6. The pile as claimed in claim 1, further comprising grease located between said shaft and said frost sleeve.

7. The pile as claimed in claim 1, wherein said grout disruption plate is constructed of PVC.

8. The pile as claimed in claim 1, wherein said grout disruption plate is constructed of metal.

9. A pile for being placed in a supporting medium comprising:

shaft;

a helical blade, operatively connected to said shaft, having a leading edge and a trailing edge and configured to move the pile into the supporting medium;

a lateral compaction protrusion, formed on said shaft, to create an annulus within the supporting medium, the annulus, created by said lateral compaction protrusion, having a diameter greater than a diameter of said shaft; and a frost sleeve surrounding said shaft;

said frost sleeve being located on said shaft between a top of the soil and a frost line;

said frost sleeve being unattached to said shaft; the pile further comprising: a grout disruption plate; said grout disruption plate being located at the frost line, wherein said grout disruption plate is attached to said frost sleeve.

10. The pile as claimed in claim 9, wherein said frost sleeve has a length equal to a distance between the top of the soil and the frost line.

11. The pile as claimed in claim 9, wherein said frost sleeve has a length greater than a distance between the top of the soil and the frost line.

12. The pile as claimed in claim 9, wherein said frost sleeve is constructed of PVC.

13. The pile as claimed in claim 9, wherein said frost sleeve is constructed of metal.

14. The pile as claimed in claim 9, further comprising grease located between said pile shaft and said frost sleeve.

15. The pile as claimed in claim 9, wherein said grout disruption plate is constructed of PVC.

16. The pile as claimed in claim 9, wherein said grout disruption plate is constructed of metal.

* * * * *